US008205405B2

(12) United States Patent
Sawada et al.

(10) Patent No.: US 8,205,405 B2
(45) Date of Patent: Jun. 26, 2012

(54) WALL STRUCTURE

(75) Inventors: Koji Sawada, Anjo (JP); Yoshinori Hibino, Ama-gun (JP)

(73) Assignee: Nichiha Corporation, Nagoya-Shi (JP)

( * ) Notice: Subject to any disclaimer, the term of this patent is extended or adjusted under 35 U.S.C. 154(b) by 94 days.

(21) Appl. No.: 12/795,413

(22) Filed: Jun. 7, 2010

(65) Prior Publication Data

US 2010/0326002 A1 Dec. 30, 2010

(30) Foreign Application Priority Data

Jun. 24, 2009 (JP) ..... 2009-149999

(51) Int. Cl.
*B44F 9/00* (2006.01)

(52) U.S. Cl. ..... 52/316; 52/446; 52/459; 52/515; 52/516

(58) Field of Classification Search ..... 52/515, 52/516, 591.4, 446, 311.1, 316, 254, 443, 52/450, 451, 459
See application file for complete search history.

(56) References Cited

U.S. PATENT DOCUMENTS

| | | | | |
|---|---|---|---|---|
| 4,722,158 | A * | 2/1988 | Urdaneta | 52/316 |
| 5,651,912 | A * | 7/1997 | Mitsumoto et al. | 249/134 |
| D653,777 | S * | 2/2012 | Damen | D25/138 |
| 2001/0004821 | A1* | 6/2001 | Kaneko et al. | 52/483.1 |
| 2003/0079429 | A1* | 5/2003 | Rodlin | 52/311.1 |
| 2007/0186501 | A1* | 8/2007 | Kuelker | 52/506.06 |
| 2009/0193742 | A1* | 8/2009 | Wolf et al. | 52/311.1 |
| 2009/0308001 | A1* | 12/2009 | Wu et al. | 52/173.3 |

FOREIGN PATENT DOCUMENTS

| | | | | |
|---|---|---|---|---|
| JP | 2592501 | Y2 | | 1/1999 |
| JP | 2001-254498 | A | | 9/2001 |
| JP | 2002-146990 | A | | 5/2002 |
| JP | 2004251109 | A | * | 9/2004 |
| JP | 2005036550 | A | * | 2/2005 |

* cited by examiner

*Primary Examiner* — Robert Canfield
*Assistant Examiner* — Jody Giacoman
(74) *Attorney, Agent, or Firm* — Birch, Stewart, Kolasch & Birch, LLP

(57) ABSTRACT

A wall structure is provided, which, despite having a surface that is covered with elastic coating material and that is jointless, has an uneven pattern in the surface, and which does not require any great effort in the coating process and exhibit little variation in the finished design. The wall structure has a wall material, an elastic joint material, a mesh-shaped material and an elastic coating material. The surface of the wall material bears an uneven pattern in which the height difference between deepest portions and highest portions is 2.0 to 4.0 mm and a pattern loss ratio is 15% or less, and furthermore, the wall material is fixed in a state where a side end portion of the wall material is abutted against a side end portion of another wall material. The elastic joint material covers the surface of the abutting portion of the side end portions of the wall materials, and the elastic coating material covers the entire surfaces of the wall materials and of the elastic joint material. The uneven pattern in the surface of the wall is formed by coating the uneven surface of the wall material with the elastic coating material, and the amount of the elastic coating material is 2 to 6 kg/m$^2$.

15 Claims, 9 Drawing Sheets

WALL STRUCTURE

BACKGROUND OF THE INVENTION

1. Field of the Invention

The present invention relates to a wall structure having a surface that is covered with an elastic material and that is jointless.

2. Description of the Related Art

Conventionally, a wall surface such as an external wall, internal wall, or the like, has been formed by constructing a plurality of sheets of wall material, such as ceramic siding board, metal siding board, ALC board, or the like, in a residence. However, joint lines occur at the abutting portions between the wall materials, and this detracts from the external appearance. Therefore, a construction structure which eliminates the joint lines and has a jointless finish has been investigated.

For example, Japanese Utility Model Registration No. 2592501 discloses a jointless external wall structure in which an elastic joint material is spread on the abutting portion of the wall members, a mesh is placed thereon, an elastic joint material is further covered thereover, and moreover an elastic coating material is coated thereon.

Furthermore, Japanese Patent Application Laid-Open No. 2001-254498 describes a single-component curable elastic composition in which an elastic joint material has an organic solvent content of less than 5 wt % and consists of a urethane polymer containing two or more isocyanate groups per molecule obtained by reacting together an aliphatic diisocyanate compound and/or an alicyclic diisocyanate compound, and a compound which generates two or more thiol groups per molecule by hydrolysis, a thiourethane bond being formed by reaction between the isocyanate groups and the thiol groups. Furthermore, this reference also describes a jointless external wall structure using this elastic joint material.

Moreover, Japanese Patent Application Laid-Open No. 2002-146990 describes a jointless external wall structure using a mesh having opening sections comprising long diameter portions following joint lines occurring in abutting portions of external wall materials and short diameter portions which are shorter than the long diameter portions and follow a direction perpendicular to the joint lines, wherein the mesh has 10 to 60 openings per 1 $Cm^2$.

However, in a conventional jointless wall structure, generally, a wall material having a flat surface is used and a pattern is applied thereto in the method of applying the elastic coating material. In Japanese Utility Model Registration No. 2592501, Japanese Patent Application Laid-Open No. 2001-254498 and Japanese Patent Application Laid-Open No. 2002-146990, there is no mention of applying a pattern to the surface of the wall.

If a pattern is applied by means of the method for applying an elastic coating material, there are problems in that the more complicated the design of the pattern, the greater the effort required in coating, and the greater the variation in the finished design due to the fact that the pattern is crafted by hand in the construction site.

SUMMARY OF THE INVENTION

The present invention was contrived in view of these problems of the prior art, and an object of the present invention is to provide a wall structure which, despite having a surface that is covered with elastic coating material and is jointless, has an uneven pattern in the surface, without requiring a great effort in the coating process and with little variation in the finished design.

The present invention provides a wall structure, the surface of which is covered with elastic coating material and is jointless, and which has an uneven pattern in the surface. The wall structure according to the present invention has a wall material, an elastic joint material, a mesh-shaped material, and an elastic coating material. The wall material has an uneven pattern in the surface, and is fixed in a state where the side end portion of the wall material is abutted with a side end portion of another wall material. The elastic joint material covers the surface of the abutting portion of the side end portions of the wall materials. The mesh-shaped material has a plurality of openings through which the elastic joint material can pass and is disposed inside the elastic joint material, and the elastic coating material covers the entire surfaces of the wall material and the elastic joint material. Furthermore, an uneven pattern is formed in the surface of the wall by coating the uneven pattern of the wall material with the elastic coating material. The height difference between the deepest portion and the highest portion of the uneven pattern of the wall material is 2.0 to 4.0 mm; the pattern loss ratio of the uneven pattern of the wall material is 15% or less. Moreover, the amount of the elastic coating material coating the surfaces of the wall material and the elastic joint material is 2 to 6 $kg/m^2$. The pattern loss ratio means the ratio of the space of the wall material surface lost by the formation of a pattern with respect to the entire volume of the wall material (the product of the thickness, length and width). Furthermore, disposing the mesh-shape body inside the elastic joint material means adopting a structure in which, for instance, an elastic joint material is spread over the abutting portion of the wall materials, the mesh-shaped material is placed thereon, and a further elastic joint material is applied thereon.

In the present invention, the wall material is a ceramic siding board, such as a wood fiber-reinforced cement board, a fiber-reinforced cement board, a fiber-reinforced cement/calcium silicate board, or the like, or a metallic siding board, an ALC board, or the like.

The mesh-shaped material is a mesh manufactured from an inorganic material or an organic material, a woven or knitted fabric, sheet, or the like. A mesh-shaped material which is manufactured using an expandable and contractable material, such as polyester, nylon, tetron, natural fiber, or the like, is desirable, since it is able to respond to expansion or contraction of the wall material over time.

The elastic joint material is an elastic material, such as a polythiourethane, polyurethane, acrylic, acrylic urethane, modified silicone, polysulfide, modified polysulfide material, or the like.

An elastic coating material is a coating material having excellent weatherproofing, elasticity and waterproofing, such as an acrylic, acrylic silicone, urethane, or modified silicone material, or the like.

In the present invention, the wall material is fixed in a state where the side end portion thereof is abutted against a side end portion of a further wall material, and the elastic joint material covers the surface of the abutting portion of the side end portions of the wall materials. Since the elastic coating material covers the entire surfaces of the wall materials and the elastic joint material, then no joint lines occur in the wall surface due to the abutting of the wall materials and it is possible to provide a jointless wall structure. Furthermore, since a mesh-shaped material having a plurality of openings through which the elastic joint material can pass is disposed inside the elastic joint material, the elastic joint material is reinforced, the expansion and contraction over time of the abutting region of the side end portions of the wall material is suppressed, and cracks are not liable to occur in the elastic coating material.

Moreover, in the present invention, since the surface of the wall material has an uneven pattern in which the height difference between the deepest portion and the highest portion is 2.0 to 4.0 mm, and the pattern loss ratio is 15% or less, then if the wall material is covered with an elastic coating material, an uneven pattern is formed in the surface of the wall by means of the elastic coating material covering the uneven pattern of the wall material. In other words, an uneven pattern is not applied to the wall by means of the method for applying the elastic coating material, and it is possible to apply the elastic coating by means of a general spray coating method, thus making it possible to provide a wall structure having good workability and little variation in the finished design, without requiring great effort in the coating process. If the height difference between the deepest portion and the highest portion of the uneven pattern of the wall material is smaller than 2.0 mm, then the uneven pattern in the wall is not distinct after the application of the elastic coating material and the external appearance is poor. On the other hand, if the height difference between the deepest portion and the highest portion of the wall material is greater than 4.0 mm, then portions are formed where either the elastic coating material cannot be applied, or where the amount applied is extremely small, thus resulting in a poor external appearance, as well as giving rise to problems with weatherproofing and waterproofing. Moreover, if the pattern loss ratio of the wall material is greater than 15%, then there are concerns about the occurrence of problems with the wall strength.

Furthermore, in the present invention, since the amount of elastic coating material covering the surfaces of the wall material and the elastic joint material is 2 to 6 kg/m$^2$, then the wall has excellent weatherproofing and waterproofing, and it is also possible to respond to expansion and contraction of the wall material over time.

Moreover, in the present invention, desirably, a pocket for filling elastic joint material is formed in the surface of the abutting portion of the side end portions of the wall materials, the pocket having a width of 1.0 to 60 mm centered on the abutting portion of the wall material, extending along the abutting portion, and having a deepest portion 0.5 to 5.0 mm deeper than the deepest portion of the concave portions of the wall material, and the elastic joint material being filled into the pocket for filling elastic joint material, because when the surface of the elastic joint material is covered by the elastic coating material, a sufficient amount of the elastic joint material is disposed on the abutting portion of the side end portions of the wall materials, and furthermore, a sufficient amount of elastic coating material is further disposed thereon, which means that the expansion and contraction over time of the abutting portion of the side end portions of the wall materials is further suppressed, and cracks are not liable to occur in the elastic coating material. If the width of the pocket for filling elastic joint material is less than 1.0 mm, then the pocket for filling elastic joint material is small, a sufficient amount of elastic joint material and/or elastic coating material is not disposed in the abutting portion of the side end portions of the wall materials, and therefore the expansion and contraction over time of the abutting portion of the side end portions of the wall material is not suppressed and there is a concern that cracks may occur in the elastic coating material. Furthermore, even if the depth of the deepest portion of the pocket for filling elastic joint material is 0.5 mm smaller than the deepest portion of the concave portions of the wall material, the pocket for filling the elastic joint material is small and a sufficient amount of elastic joint material and/or the elastic coating material is not disposed in the abutting portion of the side end portions of the wall materials, and therefore expansion and contraction over time of the abutting portion of the side end portions of the wall material is not suppressed and there is a concern that cracks may occur in the elastic coating material. On the other hand, if the width of the pocket for filling elastic joint material is greater than 60 mm, the pocket for filling elastic joint material is too large, and it becomes necessary to use a large quantity of elastic joint material, despite which marked beneficial effects are not obtained in comparison with a case where the width of the pocket is 60 mm, and time and effort are required in applying the elastic joint material. Furthermore, even if the depth of the deepest portions of the pocket for filling elastic joint material is 5.0 mm deeper than the deepest portion of the concave portions of the wall material, it becomes necessary to use a large quantity of elastic joint material, despite which marked beneficial effects are not obtained in comparison with a case where the width of the pocket is 5.0 mm, and time and effort are required in applying the elastic joint material.

Moreover, in the present invention, if there are 3 to 9 openings per cm$^2$ in the surface of the mesh-shaped material and the elastic joint material is filled into the openings, then the elastic joint material disposed above and below the mesh-shaped material is united into a single body, in addition to which the contact surface area between the mesh-shaped material and the elastic joint material is large and the mesh-shaped material and the elastic joint material are not liable to peel apart. This is desirable, because in this way the expansion and contraction over time of the abutting portion of the side end portions of the wall materials is further suppressed and cracks become less liable to occur in the elastic coating material. If the number of openings is less than 3 per cm$^2$, then there is insufficient unification of the elastic joint process disposed above and below the mesh-shaped material, the expansion and contraction over time of the abutted portion of the side end portions of the wall materials is not suppressed, and there is a concern about cracks occurring in the elastic coating material. On the other hand, if the number of openings per cm$^2$ is greater than 9, then when the surface of the wall material having an uneven shape is covered with the elastic joint material and the mesh-shaped material, the elastic joint material cannot pass sufficiently through the openings, the mesh-shaped material floats up from the surface of the elastic joint material and there are concerns that the external appearance may be affected.

Moreover, in the present invention, desirably, the width of the concave portions or the convex portions of the wall material is equal to or greater than 5 mm, since the uneven pattern in the surface of the wall which is covered with the elastic coating material better reflects the uneven pattern of the wall material. If the width of the concave portions or convex portions of the wall material is less than 5 mm, then there is a concern that the uneven pattern in the surface of the wall which is covered with the elastic coating material may not reflect the uneven pattern of the wall material.

Furthermore, in the present invention, the surface of the elastic joint material may be matched to the height of the wall materials disposed to the left and right-hand sides thereof, or may be higher or lower than the wall materials. However, when the elastic coating material is applied onto the elastic joint material, the height of the surface thereof is formed to the same height as the portion of the wall material where the elastic coating material is applied.

Moreover, the surface of the elastic joint material may be a flat surface, but may also be formed with an uneven pattern. If the surface of the elastic joint material is a flat surface, then the surface of the elastic coating material applied thereon also forms a flat surface, but considering the uneven pattern of the wall materials disposed to the left and right-hand side, no sense of incongruity occurs in the external appearance of the wall. On the other hand, if an uneven pattern is formed in the surface of the elastic joint materials, the surface of the elastic coating material applied thereon also forms an uneven pattern, and desirably, an uneven pattern which is continuous with the uneven pattern of the surface of the wall materials is formed in the surface of the elastic joint material, since the uneven pattern of the wall thereby becomes continuous and good external appearance is achieved. The surface processing of the elastic joint material is carried, for instance, by disposing the elastic joint material and then evening out and pressing the surface thereof with a spatula, or the like.

Moreover, in the present invention, if the elastic joint material is disposed only so as to fill in the pocket for filling elastic joint material, and the height of the surface of the elastic joint material is matched to the height of the surface of the abutted wall materials, then undesirable concave and convex portions are not formed in the surface of the wall materials, even if the elastic coating material is applied by a general spray coating method. Consequently, when applying the elastic coating material, it is not necessary to pay attention in order that the spread portion of the elastic joint material does not form undesirable concave and convex portions, and therefore the workability is further improved, in addition to which the variation in the finished design is further reduced and the external appearance of the wall is even better.

According to the present invention, it is possible to provide a wall structure which, despite having a surface that is covered with elastic coating material and is jointless, has an uneven pattern in the surface, without requiring a great effort in the coating process and with little variation in the finished design.

DESCRIPTION OF THE PREFERRED EMBODIMENTS

Below, the present invention is described in detail with reference to the drawings.

Figure 1:
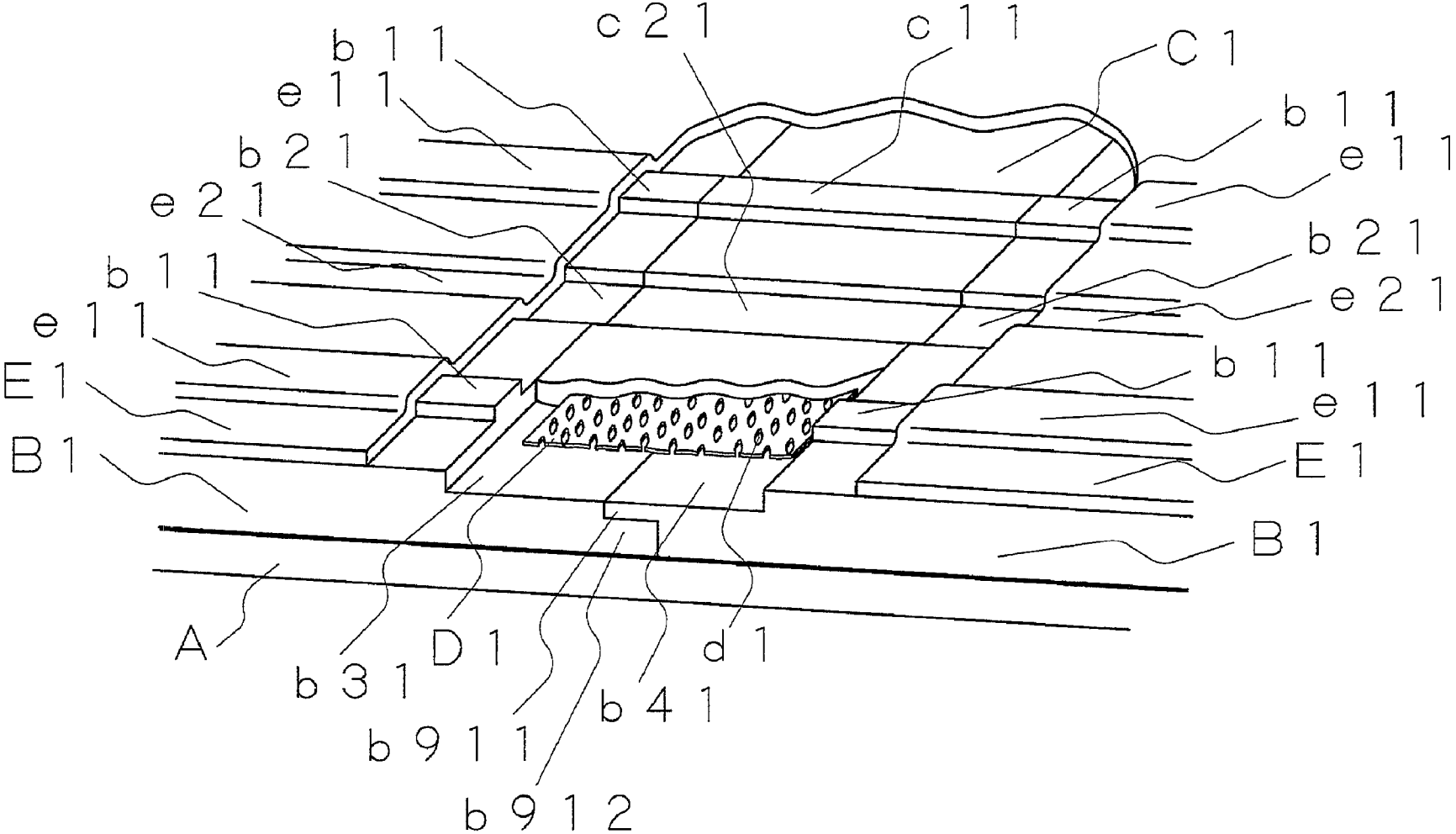
FIG. 1 is an explanatory perspective diagram showing the structure of the vicinity of an abutting portion of wall materials according to one embodiment of a wall structure according to the present invention.

FIG. 1 is an explanatory perspective diagram showing the structure in the vicinity of an abutting portion of wall materials according to one embodiment of a wall structure according to the present invention.

In the wall structure shown in FIG. 1, a wood fiber-reinforced cement board B1 having a thickness of 14 mm, a width of 910 mm and a length of 3030 mm and comprising a shiplap portion b912 in the right-side end portion and a shiplap portion b911 in the left-side end portion is used as a wall material, a polythiourethane joint material C1 is used as an elastic joint material, a 0.4 mm-thick and 50 mm-wide polyester sheet D1 having five openings d1 perforating the surface thereof per $cm^2$ is used as a mesh-shaped material, and an acrylic elastic coating material E1 is used as an elastic coating material.

Two wood fiber-reinforced cement boards B1, B1 are fixed to an underlying material A by nails (not illustrated), with their respective side end portions mutually abutted. Since the wood fiber-reinforced cement boards B1 have a shiplap portion b912 in the right-side end portion and a shiplap portion b911 in the left-side end portion, then a state of abutment of the side end portions means a state where respective shiplap portions b911 and b912 are rabbeted, as shown in FIG. 1. Furthermore, as shown in FIG. 1, the wood fiber-reinforced cement boards B1 each have an uneven pattern consisting of convex portions b11 and concave portions b21 in the surface thereof, and the depth of the deepest portion of the concave portions b21 is 3.0 mm from the highest portion of the convex portions b11 and the pattern loss ratio is 11%. The maximum widths of the convex portions b11 and the concave portions b21 are both greater than 5 mm. Moreover, the wood fiber-reinforced cement boards B1 have, in the surface of the right-side end portion thereof, concave portion b31 for filling elastic joint material extending in the abutting direction of the wood fiber-reinforced cement boards B1, and have, in the surface of the left-side end portion thereof, concave portion b41 for filling elastic joint material extending in the abutting direction of the wood fiber-reinforced cement boards B1. The concave portion b31 and concave portion b41 are 1.5 mm deeper than the deepest portion of the concave portions b21 of the wood fiber-reinforced cement boards B1, and have 30 mm-wide.

Therefore, in a state where the respective side end portions of the wood fiber-reinforced cement boards B1, B1 are abutted against each other, a space extending along the abutting portion is formed in the surface of the abutting portion by the concave portion b31 for filling elastic joint material and the concave portion b41 for filling elastic joint material. The space is 1.5 mm deeper than the deepest portion of the concave portions b21, and has 60 mm-wide. The space is a pocket for filling elastic joint material, and the polythiourethane joint material C1 is filled into the pocket for filling elastic joint material. The polythiourethane joint material C1 is applied only so as to fill into this pocket for filling elastic joint material.

A polyester sheet D1 having a smaller width than width of the pocket for filling elastic joint material is disposed inside the polythiourethane joint material C1 which is filled into the pocket for filling elastic joint material, thereby reinforcing the polythiourethane joint material C1. The polyester sheet D1 has five openings d1 perforating the surface per $cm^2$, and the polythiourethane joint material C1 is filled into the openings d1.

Furthermore, in the surface of the polythiourethane joint material C1 filled into the pocket for filling elastic joint material, convex portions c11 and concave portions c21 are provided so as to be continuous with the uneven pattern of the abutted wood fiber-reinforced cement boards B1, B1, and the heights of the convex portions and concave portions are matched.

The surfaces of the wood fiber-reinforced cement boards B1, B1 and the polythiourethane joint material C1 are covered entirely with an acrylic elastic coating material E1, and in the surface of this acrylic elastic coating material E1 there are formed convex portions e11 originating from the convex portions b11 of the wood fiber-reinforced cement board B1, concave portions e21 originating from the concave portions b21 of the wood fiber-reinforced cement board B1, convex portions originating from the convex portions c11 of the polythiourethane joint material C1 and concave portions originating from the concave portions c21 of the polythiourethane joint material C1. In other words, an uneven pattern originating from the uneven pattern in the wood fiber-reinforced cement board B1 and the uneven pattern in the polythiourethane joint material C1 is formed in the surface of the acrylic elastic coating material E1. The acrylic elastic coating material E1 is applied at a rate of 2 $kg/m^2$ or greater. The height of the surface of the acrylic elastic coating material E1 which coats the surface of the wood fiber-reinforced cement board B1 is matched to the height of the surface of the acrylic elastic coating material E1 which coats the surface of the polythiourethane joint material C1. In other words, the height of the surface of the convex portions e11 of the acrylic elastic coating material E1 originating from the convex portions b11 of the wood fiber-reinforced cement board B1 is matched to the height of the surface of the convex portions of the acrylic elastic coating material E1 originating from the convex portions c11 of the polythiourethane joint material C1, and the height of the surface of the convex portions e21 of the acrylic elastic coating material E1 originating from the concave portions b21 of the wood fiber-reinforced cement board B1 is matched to the height of the surface of the concave portions of the acrylic elastic coating material E1 originating from the concave portions c21 of the polythiourethane joint material C1.

Therefore, according to the wall structure shown in FIG. 1, although the surface is covered with the acrylic elastic coating material E1 and is jointless, it is possible for the surface to have an uneven pattern. Since the uneven pattern in the surface is created by the uneven pattern in the wood fiber-reinforced cement boards B1 and the uneven pattern in the polythiourethane joint material C1, and a pattern is not applied by means of the method for applying the acrylic elastic coating material E1, then great effort is not required in the coating process and there is little variation in the finished design.

Furthermore, since the depth of the deepest portion of the concave portions b21 of the wood fiber-reinforced cement board B1 is 3.0 mm from the highest portion of the convex portions b11, and the pattern loss ratio is 11%, then the uneven pattern of the wood fiber-reinforced cement board B1 is better reflected in the uneven pattern of the wall, creating a good external appearance, in addition to which weatherproofing and waterproofing are excellent, and there are no problems in respect of the strength of the wall.

Moreover, since a 60 mm-wide pocket for filling elastic joint material which is 1.5 mm deeper than the deepest portion of the concave portions b21 and extends following the abutting portion is formed in the surface of the abutting portion of the side end portions of the wood fiber-reinforced cement boards B1, B1, since the polythiourethane joint material C1 is filled into the pocket for filling elastic joint material, and since the surface of the polythiourethane joint material C1 is coated with acrylic elastic coating material E1 at a rate of 2 $kg/m^2$ or greater, then a sufficient amount of polythiourethane joint material C1 is disposed in the abutting portion of the side end portions of the wood fiber-reinforced cement boards B1, B1, a sufficient amount of acrylic elastic coating material E1 is also disposed thereon, expansion and contraction over time of the abutting portion of the side end portions of the wood fiber-reinforced cement boards B1, B1 is suppressed, and cracks are not liable to occur in the acrylic elastic coating material E1.

Moreover, since the polyester sheet D1 having five openings d1 perforating the surface per $cm^2$ is disposed inside the polythiourethane joint material C1 in a state where the polythiourethane joint material C1 is filled into the openings d1, then the polythiourethane joint material C1 and the polyester sheet D1 are united into a single body, thereby reinforcing the polythiourethane joint material C1, further suppressing expansion or contraction over time of the abutting portion of the side end portions of the wood fiber-reinforced cement boards B1, B1, and making cracks even less liable to occur in the acrylic elastic coating material E1.

Furthermore, since the height of the surface of the polythiourethane joint material C1 is matched to the height of the surfaces of the abutted wood fiber-reinforced cement boards B1, B1, then when applying the acrylic elastic coating material E1, it is not necessary to pay attention so that the spread portion of the polythiourethane joint material C1 does not create unwanted concave and convex portions in the wall, and hence workability is further improved, variations in the finished design are further reduced, and the external appearance of the wall is even better.

Figure 2:
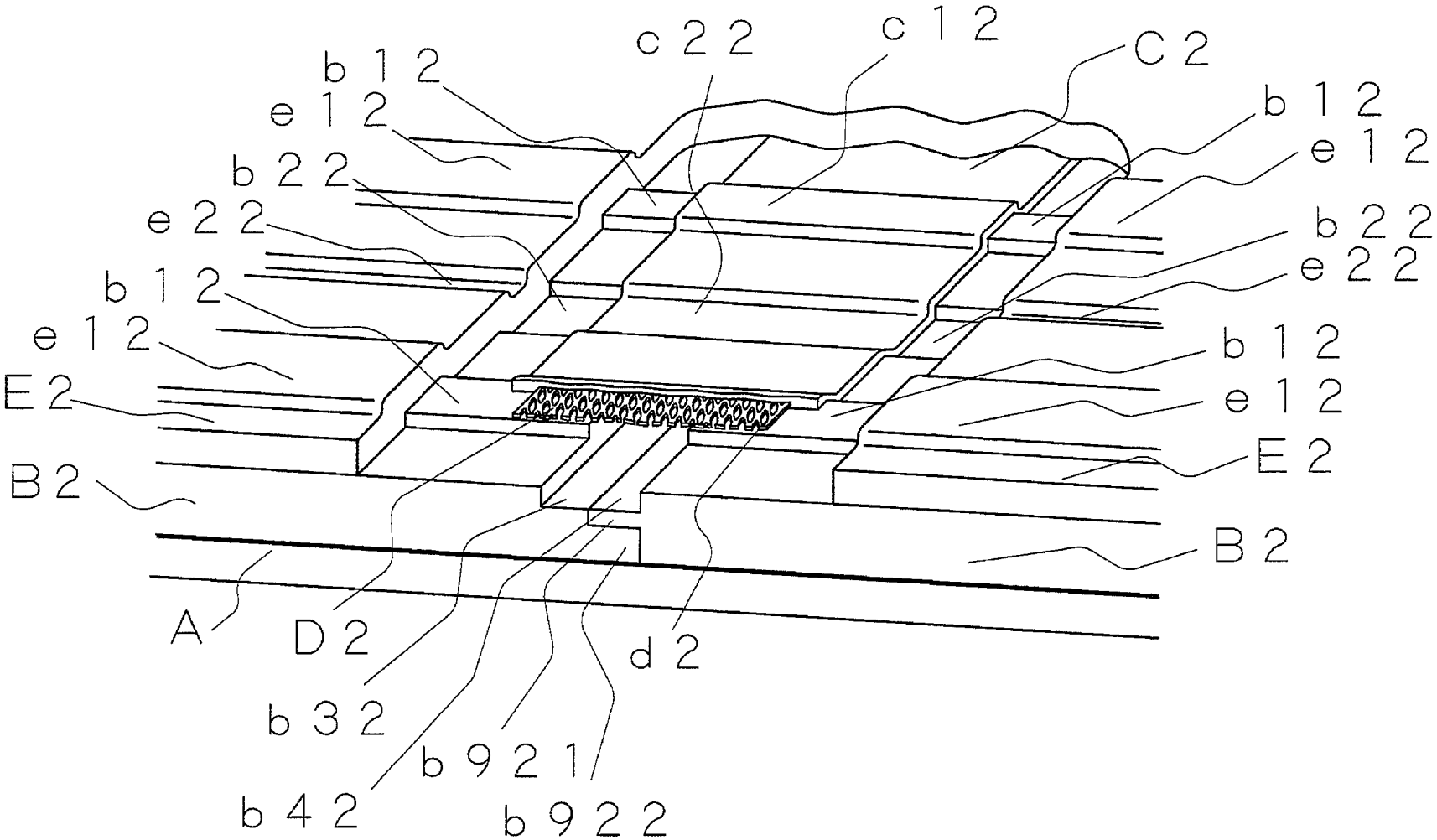
FIG. 2 is an explanatory perspective diagram showing the structure of the vicinity of an abutting portion of wall materials according to a further embodiment of a wall structure according to the present invention.

FIG. 2 is an explanatory perspective diagram showing the structure of the vicinity of the abutting portion of wall materials according to a further embodiment of the wall structure according to the present invention.

In the wall structure shown in FIG. 2, a wood fiber-reinforced cement board B2 having a thickness of 14 mm, a width of 910 mm and a length of 3030 mm and comprising a shiplap portion b922 in the right-side end portion and a shiplap portion b921 in the left-side end portion is used as a wall material, a polythiourethane joint material C2 is used as an elastic joint material, a 0.4 mm-thick and 50 mm-wide polyester sheet D2 having nine openings d2 perforating the surface thereof per $cm^2$ is used as a mesh-shaped material, and an acrylic elastic coating material E2 is used as an elastic coating material.

Two wood fiber-reinforced cement boards B2, B2 are fixed to an underlying material A by nails (not illustrated), with their respective side end portions mutually abutted. Since the wood fiber-reinforced cement boards B2 have a shiplap portion b922 in the right-side end portion and a shiplap portion b921 in the left-side end portion, then a state of abutment of the side end portions means a state where respective shiplap portions b921 and b922 are rabbeted, as shown in FIG. 2. Furthermore, as shown in FIG. 2, the wood fiber-reinforced cement boards B2 have an uneven pattern consisting of convex portions b12 and concave portions b22 in the surface thereof, and the depth of the deepest portion of the concave portions b22 is 3.0 mm from the highest portion of the convex portions b12 and the pattern loss ratio is 11%. The maximum widths of the convex portions b12 and the concave portions b22 are both greater than 5 mm. Moreover, the wood fiber-reinforced cement boards B2 have, in the surface of the right-side end portion thereof, concave portion b32 for filling elastic joint material extending in the abutting direction of the wood fiber-reinforced cement boards B2, and have, in the surface of the left-side end portion thereof, concave portion b42 for filling elastic joint material extending in the abutting direction of the wood fiber-reinforced cement boards B2. The concave portion b32 and concave portion b42 are 1.5 mm deeper than the deepest portion of the concave portions b22, and have 10 mm-wide. Therefore, in a state where the respective side end portions of the wood fiber-reinforced cement boards B2, B2 are abutted against each other, a space extending along the abutting portion is formed in the surface of the abutting portion by the concave portion b32 for filling elastic joint material and the concave portion b42 for filling elastic joint material. The space is 1.5 mm deeper than the deepest portion of the concave portions b22, and has 20 mm-wide. The space is a pocket for filling elastic joint material, and the polythiourethane joint material C2 is filled into the pocket for filling elastic joint material. The polythiourethane joint material C2 is filled into the pocket for filling elastic joint material, and furthermore is applied so as to cover a portion of the surfaces of the wood fiber-reinforced cement boards B2, B2 also.

A polyester sheet D2 is disposed inside the polythiourethane joint material C2, thereby reinforcing the polythiourethane joint material C2. Since the width of the polyester sheet D2 is greater than the width of the pocket for filling elastic joint material, then the polyester sheet is disposed both inside the polythiourethane joint material C2 and covering the pocket for filling elastic joint material and a portion of the surfaces of the wood fiber-reinforced cement boards B2, B2. Furthermore, the polyester sheet D2 has nine openings d2 penetrating the surface per $cm^2$, and the polythiourethane joint material C2 is filled into the openings d2.

Furthermore, in the surface of the polythiourethane joint material C2 filled into the pocket for filling elastic joint material, convex portions c12 and concave portions c22 are provided so as to be continuous with the uneven pattern of the abutted wood fiber-reinforced cement boards B2, B2.

The surfaces of the wood fiber-reinforced cement boards B2, B2 and the polythiourethane joint material C2 are covered with an acrylic elastic coating material E2, and in the surface of this acrylic elastic coating material E2 there are formed convex portions e12 originating from the convex portions b12 of the wood fiber-reinforced cement board B2, concave portions e22 originating from the concave portions b22 of the wood fiber-reinforced cement board B2, convex portions originating from the convex portions c12 of the polythiourethane joint material C2 and concave portions originating from the concave portions c22 of the polythiourethane joint material C2. In other words, an uneven pattern originating from the uneven pattern in the wood fiber-reinforced cement board B2 and the uneven pattern in the polythiourethane joint material C2 is formed in the surface of the acrylic elastic coating material E2. The acrylic elastic coating material E2 is applied at a rate of 5 $kg/m^2$ or greater. The height of the surface of the acrylic elastic coating material E2 which coats the surface of the wood fiber-reinforced cement board B2 is matched to the height of the surface of the acrylic elastic coating material E2 which coats the surface of the polythiourethane joint material C2. In other words, the height of the surface of the convex portions e12 of the acrylic elastic coating material E2 originating from the convex portions b12 of the wood fiber-reinforced cement board B2 is matched to the height of the surface of the convex portions of the acrylic elastic coating material E2 originating from the convex portions c12 of the polythiourethane joint material C2, and the height of the surface of the convex portions e22 of the acrylic elastic coating material E2 originating from the concave portions b22 of the wood fiber-reinforced cement board B2 is matched to the height of the surface of the concave portions of the acrylic elastic coating material E2 originating from the concave portions c22 of the polythiourethane joint material C2.

Therefore, according to the wall structure shown in FIG. 2, although the surface is covered with the acrylic elastic coating material E2 and is jointless, it is possible for the surface to have an uneven pattern. Since the uneven pattern in the surface is created by the uneven pattern in the wood fiber-reinforced cement boards B2 and the uneven pattern in the polythiourethane joint material C2, and a pattern is not applied by means of the method for applying the acrylic elastic coating material E2, then great effort is not required in the coating process and there is little variation in the finished design.

Furthermore, since the depth of the deepest portion of the concave portions b22 of the wood fiber-reinforced cement board B2 is 3.0 mm from the highest portion of the convex portions b12, and the pattern loss ratio is 11%, then the uneven pattern of the wood fiber-reinforced cement board B2 is better reflected in the uneven pattern of the wall, creating a good external appearance, in addition to which weatherproofing and waterproofing are excellent, and there are no problems in respect of the strength of the wall.

Moreover, since a 20 mm-wide pocket for filling elastic joint material which is 1.5 mm deeper than the deepest portion of the concave portions b22 and extends following the abutting portion is formed in the surface of the abutting portion of the side end portions of the wood fiber-reinforced cement boards B2, B2, since the polythiourethane joint material C2 is filled into the pocket for filling elastic joint material, and since the surface of the polythiourethane joint material C2 is coated with acrylic elastic coating material E2 at a rate of 5 $kg/m^2$ or greater, then a sufficient amount of polythiourethane joint material C2 is disposed in the abutting portion of the side end portions of the wood fiber-reinforced cement boards B2, B2, a sufficient amount of acrylic elastic coating material E2 is also disposed thereon, expansion and contraction over time of the abutting portion of the side end portions of the wood fiber-reinforced cement boards B2, B2 is suppressed, and cracks are not liable to occur in the acrylic elastic coating material E2.

Moreover, since the polyester sheet D2 having nine openings d2 perforating the surface per $cm^2$ is disposed inside the polythiourethane joint material C2 in a state where the polythiourethane joint material C2 is filled into the openings d2, then the polythiourethane joint material C2 and the polyester sheet D2 are united into a single body, thereby reinforcing the polythiourethane joint material C2, further suppressing expansion or contraction over time of the abutting portion of the side end portions of the wood fiber-reinforced cement boards B2, B2, and making cracks even less liable to occur in the acrylic elastic coating material E2.

Figure 3:
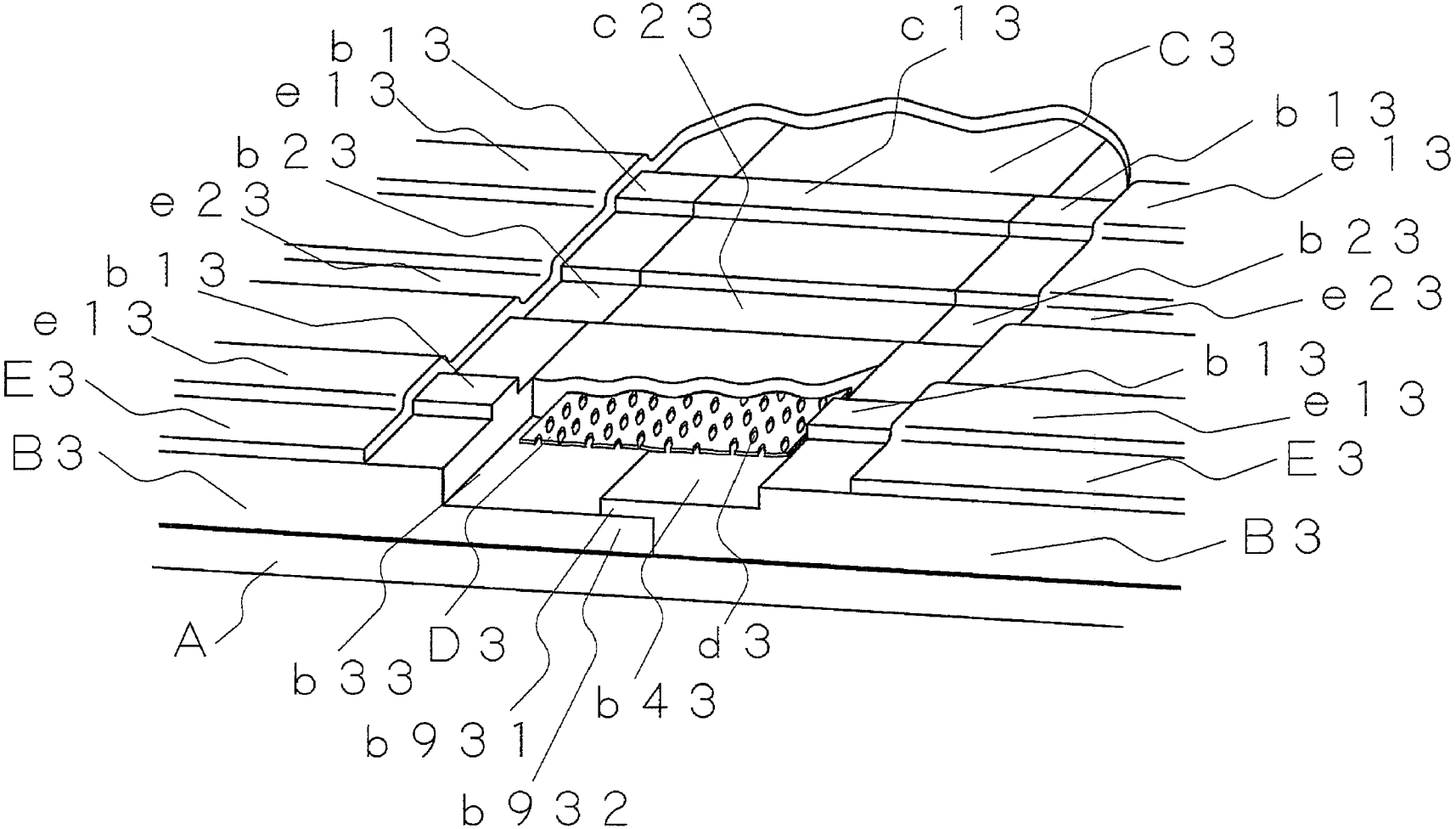
FIG. 3 is an explanatory perspective diagram showing the structure of the vicinity of an abutting portion of wall materials according to yet a further embodiment of a wall structure according to the present invention.

FIG. 3 is an explanatory perspective diagram showing the structure of the vicinity of the abutting portion of wall materials according to yet a further embodiment of the wall structure according to the present invention.

In the wall structure shown in FIG. 3, a wood fiber-reinforced cement board B3 having a thickness of 14 mm, a width of 910 mm and a length of 3030 mm and comprising a shiplap portion b932 in the right-side end portion and a shiplap portion b931 in the left-side end portion is used as a wall material, a polythiourethane joint material C3 is used as an elastic joint material, a 0.4 mm-thick and 50 mm-wide polyester sheet D3 having five openings d3 perforating the surface thereof per $cm^2$ is used as a mesh-shaped material, and an acrylic elastic coating material E3 is used as an elastic coating material. The shape of the shiplap portions b931 and b932 of the wood fiber-reinforced cement board B3 is different to that of the shiplap portions b911 and b912 of the wood fiber-reinforced cement board B1 shown in FIG. 1, but the shiplap portions b931 and b932 can be rabbeted.

Two wood fiber-reinforced cement boards B3, B3 are fixed to an underlying material A by nails (not illustrated), with their respective side end portions mutually abutted. Since the wood fiber-reinforced cement boards B3 have a shiplap portion b932 in the right-side end portion and a shiplap portion b931 in the left-side end portion, then a state of abutment of the side end portions means a state where respective shiplap portions b931 and b932 are rabbeted, as shown in FIG. 3. Furthermore, as shown in FIG. 3, the wood fiber-reinforced cement boards B3 have an uneven pattern consisting of convex portions b13 and concave portions b23 in the surface thereof, and the depth of the deepest portion of the concave portions b23 is 3.0 mm from the highest portion of the convex portions b13 and the pattern loss ratio is 11%. The maximum widths of the convex portions b13 and the concave portions b23 are both greater than 5 mm. Moreover, the wood fiber-reinforced cement boards B3 have, in the surface of the right-side end portion thereof, concave portion b33 for filling elastic joint material extending in the abutting direction of the wood fiber-reinforced cement boards B3, and have, in the surface of the left-side end portion thereof, concave portion b43 for filling elastic joint material extending in the abutting direction of the wood fiber-reinforced cement boards B3. The concave portion b33 for filling elastic joint material is 1.8 mm deeper than the deepest portion of the concave portions b23, and has 40 mm-wide. The concave portion b43 for filling elastic joint material is 1.5 mm deeper than the deepest portion of the concave portions b23, and has 30 mm-wide. Therefore, in a state where the respective side end portions of the wood fiber-reinforced cement boards B3, B3 are abutted against each other, a space extending along the abutting portion is formed in the surface of the abutting portion by the concave portion b33 for filling elastic joint material and the concave portion b43 for filling elastic joint material. The space is 1.5 to 1.8 mm deeper than the deepest portion of the concave portions b23, and has 60 mm-wide. The space is a pocket for filling elastic joint material. When the respective side end portions of the wood fiber-reinforced cement boards B3, B3 are abutted together, a portion of the surface of the concave portion b33 for filling elastic joint material is disposed below the shiplap portion b931, and therefore the width of the pocket for filling elastic joint material is 60 mm. Therefore, the polythiourethane joint material C3 is disposed so as to fill in this pocket for filling elastic joint material only.

A polyester sheet D3 having a smaller width than the pocket for filling elastic joint material is disposed inside the polythiourethane joint material C3 which is filled into the pocket for filling elastic joint material, thereby reinforcing the polythiourethane joint material C3. The polyester sheet D3 has five openings d3 penetrating the surface per $cm^2$, and the polythiourethane joint material C3 is filled into the openings d3.

Furthermore, in the surface of the polythiourethane joint material C3 filled into the pocket for filling elastic joint material, convex portions c13 and concave portions c23 are provided so as to be continuous with the uneven pattern of the abutted wood fiber-reinforced cement boards B3, B3, and the heights of the surfaces are matched.

The surfaces of the wood fiber-reinforced cement boards B3, B3 and the polythiourethane joint material C3 are covered with an acrylic elastic coating material E3, and in the surface of this acrylic elastic coating material E3 there are formed convex portions e13 originating from the convex portions b13 of the wood fiber-reinforced cement board B3, concave portions e23 originating from the concave portions b23 of the wood fiber-reinforced cement board B3, convex portions originating from the convex portions c13 of the polythiourethane joint material C3 and concave portions originating from the concave portions c23 of the polythiourethane joint material C3. In other words, an uneven pattern originating from the uneven pattern in the wood fiber-reinforced cement board B3 and the uneven pattern in the polythiourethane joint material C3 is formed in the surface of the acrylic elastic coating material E3. The acrylic elastic coating material E3 is applied at a rate of 2 $kg/m^2$ or greater. The height of the surface of the acrylic elastic coating material E3 which coats the surface of the wood fiber-reinforced cement board B3 is matched to the height of the surface of the acrylic elastic coating material E3 which coats the surface of the polythiourethane joint material C3. In other words, the height of the surface of the convex portions e13 of the acrylic elastic coating material E3 originating from the convex portions b13 of the wood fiber-reinforced cement board B3 is matched to the height of the surface of the convex portions of the acrylic elastic coating material E3 originating from the convex portions c13 of the polythiourethane joint material C3, and the height of the surface of the convex portions e23 of the acrylic elastic coating material E3 originating from the concave portions b23 of the wood fiber-reinforced cement board B3 is matched to the height of the surface of the concave portions of the acrylic elastic coating material E3 originating from the concave portions c23 of the polythiourethane joint material C3.

Therefore, according to the wall structure shown in FIG. 3, although the surface is covered with the acrylic elastic coating material E3 and is jointless, it is possible for the surface to have an uneven pattern. Since the uneven pattern in the surface is created by the uneven pattern in the wood fiber-reinforced cement boards B3 and the uneven pattern in the polythiourethane joint material C3, and a pattern is not applied by means of the method for applying the acrylic elastic coating material E3, then great effort is not required in the coating process and there is little variation in the finished design.

Furthermore, since the depth of the deepest portion of the concave portions b23 of the wood fiber-reinforced cement board B3 is 3.0 mm from the highest portion of the convex portions b13, and the pattern loss ratio is 11%, then the uneven pattern of the wood fiber-reinforced cement board B3 is better reflected in the uneven pattern of the wall, creating a good external appearance, in addition to which weatherproofing and waterproofing are excellent, and there are no problems in respect of the strength of the wall.

Moreover, since a 60 mm-wide pocket for filling elastic joint material which is 1.8 mm deeper than the deepest portion of the concave portions b23 and extends following the abutting portion is formed in the surface of the abutting portion of the side end portions of the wood fiber-reinforced cement boards B3, B3, since the polythiourethane joint material C3 is filled into the pocket for filling elastic joint material, and since the surface of the polythiourethane joint material C3 is coated with acrylic elastic coating material E3 at a rate of 2 kg/m$^2$ or greater, then a sufficient amount of polythiourethane joint material C3 is disposed in the abutting portion of the side end portions of the wood fiber-reinforced cement boards B3, B3, a sufficient amount of acrylic elastic coating material E3 is also disposed thereon, expansion and contraction over time of the abutting portion of the side end portions of the wood fiber-reinforced cement boards B3, B3 is suppressed, and cracks are not liable to occur in the acrylic elastic coating material E3.

Moreover, since the polyester sheet D3 having five openings d3 perforating the surface per cm$^2$ is disposed inside the polythiourethane joint material C3 in a state where the polythiourethane joint material C3 is filled into the openings d3, then the polythiourethane joint material C3 and the polyester sheet D3 are united into a single body, thereby reinforcing the polythiourethane joint material C3, further suppressing expansion or contraction over time of the abutting portion of the side end portions of the wood fiber-reinforced cement boards B3, B3, and making cracks even less liable to occur in the acrylic elastic coating material E3.

Furthermore, since the height of the surface of the polythiourethane joint material C3 is matched to the height of the surfaces of the abutted wood fiber-reinforced cement boards B3, B3, then when applying the acrylic elastic coating material E3, it is not necessary to pay attention so that the spread portion of the polythiourethane joint material C3 does not create unwanted concave and convex portions in the wall, and hence workability is further improved, variations in the finished design are further reduced, and the external appearance of the wall is even better.

Figure 4:
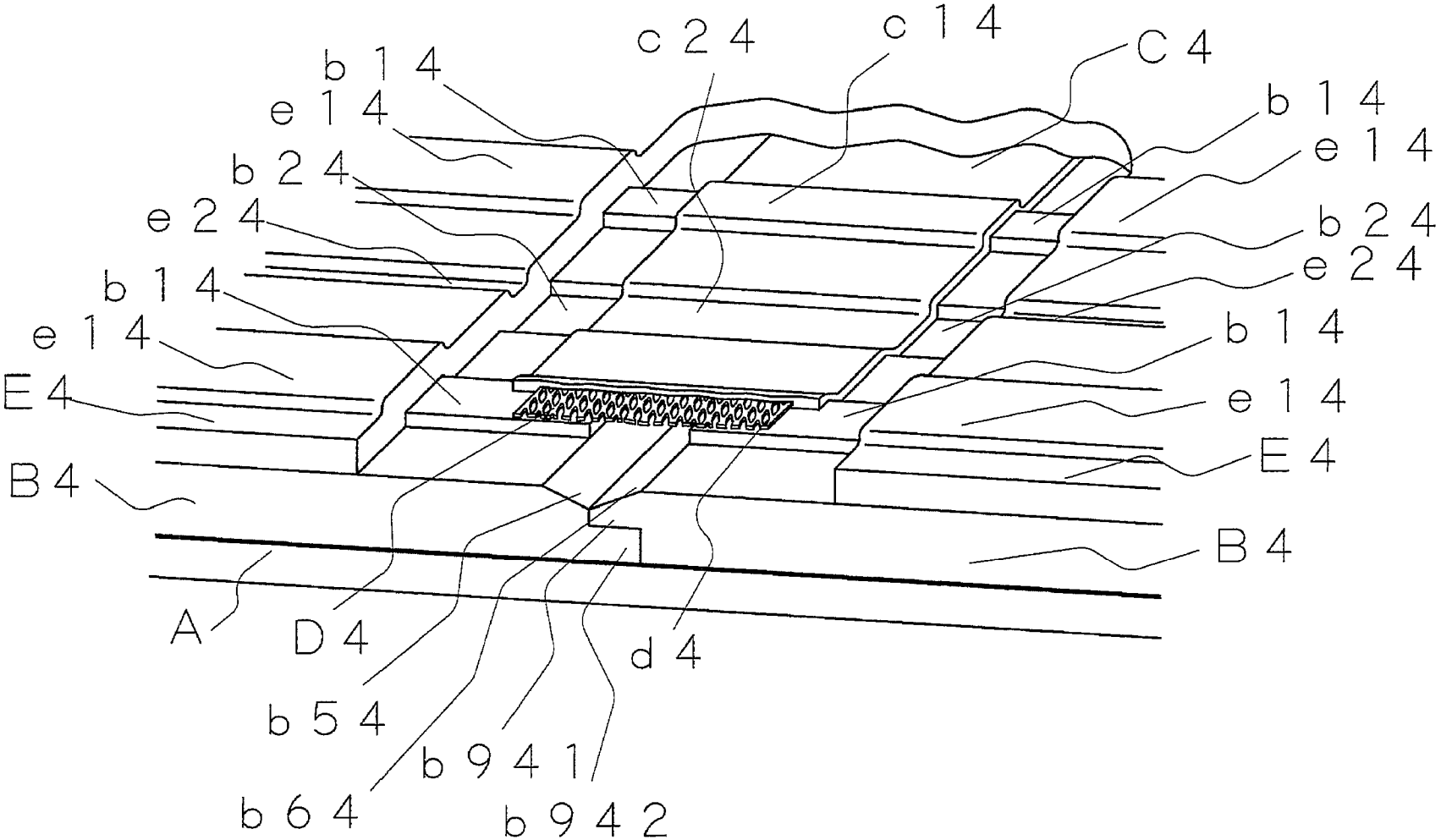
FIG. 4 is an explanatory perspective diagram showing the structure of the vicinity of an abutting portion of wall materials according to yet a further embodiment of a wall structure according to the present invention.

FIG. 4 is an explanatory perspective diagram showing the structure of the vicinity of the abutting portion of wall materials according to yet a further embodiment of the wall structure according to the present invention.

In the wall structure shown in FIG. 4, a wood fiber-reinforced cement board B4 having a thickness of 14 mm, a width of 910 mm and a length of 3030 mm and comprising a shiplap portion b942 in the right-side end portion and a shiplap portion b941 in the left-side end portion is used as a wall material, a polythiourethane joint material C4 is used as an elastic joint material, a 0.4 mm-thick and 50 mm-wide polyester sheet D4 having nine openings d4 perforating the surface thereof per cm$^2$ is used as a mesh-shaped material, and an acrylic elastic coating material E4 is used as an elastic coating material.

Two wood fiber-reinforced cement boards B4, B4 are fixed to an underlying material A by nails (not illustrated), with their respective side end portions mutually abutted. Since the wood fiber-reinforced cement boards B4 have a shiplap portion b942 in the right-side end portion and a shiplap portion b941 in the left-side end portion, then a state of abutment of the side end portions means a state where respective shiplap portions b941 and b942 are rabbeted, as shown in FIG. 4. Furthermore, as shown in FIG. 4, the wood fiber-reinforced cement boards B4 have an uneven pattern consisting of convex portions b14 and concave portions b24 in the surface thereof, and the depth of the deepest portion of the concave portions b24 is 3.0 mm from the highest portion of the convex portions b14 and the pattern loss ratio is 11%. The maximum widths of the convex portions b14 and the concave portions b24 are both greater than 5 mm. Moreover, the wood fiber-reinforced cement boards B4 have, in the surface of the right-side end portion thereof, inclined portion b54 for filling elastic joint material extending in the abutting direction of the wood fiber-reinforced cement boards B4, and have, in the surface of the left-side end portion thereof, inclined portion b64 for filling elastic joint material extending in the abutting direction of the wood fiber-reinforced cement boards B4. The inclined portion b54 for filling elastic joint material has 10 mm-wide, and is inclined from the inner side of the wood fiber-reinforced cement board B4. The deepest portion of the inclined portion b54 is 1.5 mm deeper than the deepest portion of the concave portions b24. The inclined portion b64 for filling elastic joint material has 10 mm-wide, and is inclined from the inner side of the wood fiber-reinforced cement board B4. The deepest portion of the inclined portion b64 is 1.5 mm deeper than the deepest portion of the concave portions b24. Therefore, in a state where the respective side end portions of the wood fiber-reinforced cement boards B4, B4 are abutted against each other, a space having a deepest portion 1.5 mm deeper than the deepest portion of the concave portions b24 and extending along the abutting portion is formed in the surface of the abutting portion by the inclined portion b54 for filling elastic joint material and the inclined portion b64 for filling elastic joint material. The space has 20 mm-wide. The space is a pocket for filling elastic joint material, and polythiourethane joint material C4 is filled into the pocket for filling elastic joint material, as well as being disposed so as to cover a portion of the surfaces of the wood fiber-reinforced cement boards B4, B4.

A polyester sheet D4 is disposed inside the polythiourethane joint material C4, thereby reinforcing the polythiourethane joint material C4. Since the width of the polyester sheet D4 is greater than the width of the pocket for filling elastic joint material, then the polyester sheet D4 is disposed both inside the polythiourethane joint material C4 and covering the pocket for filling elastic joint material and a portion of the surfaces of the wood fiber-reinforced cement boards B4, B4. Furthermore, the polyester sheet D4 has nine openings d4 penetrating the surface per cm$^2$, and the polythiourethane joint material C4 is filled into the openings d4.

Furthermore, in the surface of the polythiourethane joint material C4, convex portions c14 and concave portions c24 are provided so as to be continuous with the uneven pattern of the abutted wood fiber-reinforced cement boards B4, B4.

The surfaces of the wood fiber-reinforced cement boards B4, B4 and the polythiourethane joint material C4 are covered with an acrylic elastic coating material E4, and in the surface of this acrylic elastic coating material E4 there are formed convex portions e14 originating from the convex portions b14 of the wood fiber-reinforced cement board B4, concave portions e24 originating from the concave portions b24 of the wood fiber-reinforced cement board B4, convex portions originating from the convex portions c14 of the polythiourethane joint material C4 and concave portions originating from the concave portions c24 of the polythiourethane joint material C4. In other words, an uneven pattern originating from the uneven pattern in the wood fiber-reinforced cement board B4 and the uneven pattern in the polythiourethane joint material C4 is formed in the surface of the acrylic elastic coating material E4. The acrylic elastic coating material E4 is applied at a rate of 5 kg/m$^2$ or greater. The height of the surface of the acrylic elastic coating material E4 which coats the surface of the wood fiber-reinforced cement board B4 is matched to the height of the surface of the acrylic elastic coating material E4 which coats the surface of the polythiourethane joint material C4. In other words, the height of the surface of the convex portions e14 of the acrylic elastic coating material E4 originating from the convex portions b14 of the wood fiber-reinforced cement board B4 is matched to the height of the surface of the convex portions of the acrylic elastic coating material E4 originating from the convex portions c14 of the polythiourethane joint material C4, and the height of the surface of the convex portions e24 of the acrylic elastic coating material E4 originating from the concave portions b24 of the wood fiber-reinforced cement board B4 is matched to the height of the surface of the concave portions of the acrylic elastic coating material E4 originating from the concave portions c24 of the polythiourethane joint material C4.

Therefore, according to the wall structure shown in FIG. 4, although the surface is covered with the acrylic elastic coating material E4 and is jointless, it is possible for the surface to have an uneven pattern. Since the uneven pattern in the surface is created by the uneven pattern in the wood fiber-reinforced cement boards B4 and the uneven pattern in the polythiourethane joint material C4, and a pattern is not applied by means of the method for applying the acrylic elastic coating material E4, then great effort is not required in the coating process and there is little variation in the finished design.

Furthermore, since the depth of the deepest portion of the concave portions b24 of the wood fiber-reinforced cement board B4 is 3.0 mm from the highest portion of the convex portions b14, and the pattern loss ratio is 11%, then the uneven pattern of the wood fiber-reinforced cement board B4 is better reflected in the uneven pattern of the wall, creating a good external appearance, in addition to which weatherproofing and waterproofing are excellent, and there are no problems in respect of the strength of the wall.

Moreover, since a 20 mm-wide pocket for filling elastic joint material which has a deepest portion 1.5 mm deeper than the deepest portion of the concave portions b24 and which extends following the abutting portion is formed in the surface of the abutting portion of the side end portions of the wood fiber-reinforced cement boards B4, B4, since the polythiourethane joint material C4 is filled into the pocket for filling elastic joint material, and since the surface of the polythiourethane joint material C4 is coated with acrylic elastic coating material E4 at a rate of 5 kg/m$^2$ or greater, then a sufficient amount of polythiourethane joint material C4 is disposed in the abutting portion of the side end portions of the wood fiber-reinforced cement boards B4, B4, a sufficient amount of acrylic elastic coating material E4 is also disposed thereon, expansion and contraction over time of the abutting portion of the side end portions of the wood fiber-reinforced cement boards B4, B4 is suppressed, and cracks are not liable to occur in the acrylic elastic coating material E4.

Moreover, since the polyester sheet D4 having nine openings d4 perforating the surface per cm$^2$ is disposed inside the polythiourethane joint material C4 in a state where the polythiourethane joint material C4 is filled into the openings d4, then the polythiourethane joint material C4 and the polyester sheet D4 are united into a single body, thereby reinforcing the polythiourethane joint material C4, further suppressing expansion or contraction over time of the abutting portion of the side end portions of the wood fiber-reinforced cement boards B4, B4, and making cracks even less liable to occur in the acrylic elastic coating material E4.

Figure 5:
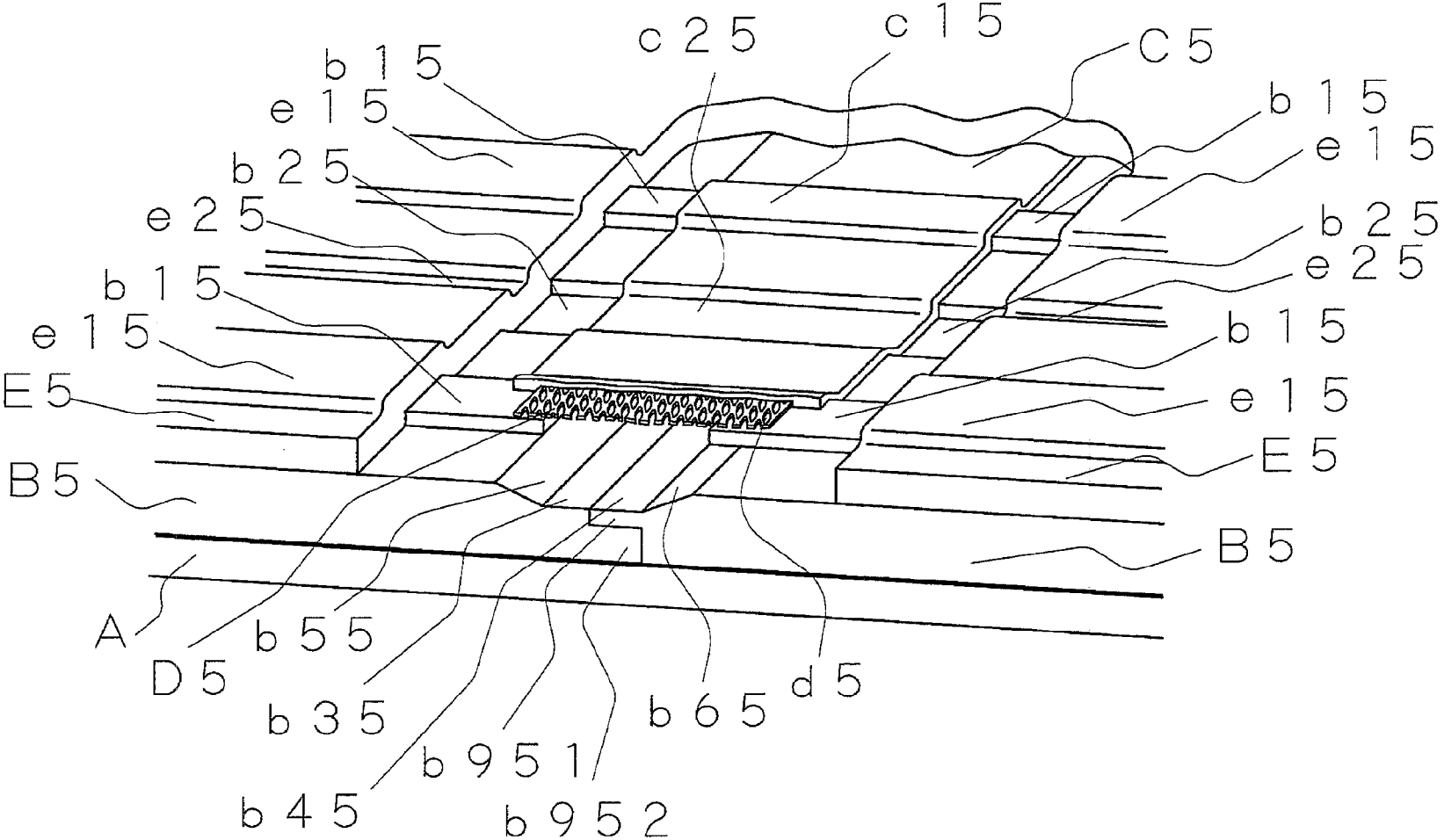
FIG. 5 is an explanatory perspective diagram showing the structure of the vicinity of an abutting portion of wall materials according to yet a further embodiment of a wall structure according to the present invention.

FIG. 5 is an explanatory perspective diagram showing the structure of the vicinity of the abutting portion of wall materials according to yet a further embodiment of the wall structure according to the present invention.

In the wall structure shown in FIG. 5, a wood fiber-reinforced cement board B5 having a thickness of 14 mm, a width of 910 mm and a length of 3030 mm and comprising a shiplap portion b952 in the right-side end portion and a shiplap portion b951 in the left-side end portion is used as a wall material, a polythiourethane joint material C5 is used as an elastic joint material, a 0.4 mm-thick and 50 mm-wide polyester sheet D5 having nine openings d5 perforating the surface thereof per cm$^2$ is used as a mesh-shaped material, and an acrylic elastic coating material E5 is used as an elastic coating material.

Two wood fiber-reinforced cement boards B5, B5 are fixed to an underlying material A by nails (not illustrated), with their respective side end portions mutually abutted. Since the wood fiber-reinforced cement boards B5 have a shiplap portion b952 in the right-side end portion and a shiplap portion b951 in the left-side end portion, then a state of abutment of the side end portions means a state where respective shiplap portions b951 and b952 are rabbeted, as shown in FIG. 5. Furthermore, as shown in FIG. 5, the wood fiber-reinforced cement boards B5 have an uneven pattern consisting of convex portions b15 and concave portions b25 in the surface thereof, and the depth of the deepest portion of the concave portions b25 is 3.0 mm from the highest portion of the convex portions b15 and the pattern loss ratio is 11%. The maximum widths of the convex portions b15 and the concave portions b25 are both greater than 5 mm. Moreover, the wood fiber-reinforced cement boards B5 have, in the surface of the right-side end portion thereof, a 10 mm-wide concave portion b35 for filling elastic joint material having a deepest portion 1.5 mm deeper than the deepest portion of the concave portions b25 and extending in the abutting direction of the wood fiber-reinforced cement boards B5, and a 10 mm-wide inclined portion b55 for filling elastic joint material extending in the abutting direction of the wood fiber-reinforced cement boards B5 and forming an inclination toward the inner side of the wood-fiber reinforced cement board B5 from the concave portion b35 for filling elastic joint material. On the other hand, the wood fiber-reinforced cement boards B5 have, in the surface of the left-side end portion thereof, a 10 mm-wide concave portion b45 for filling elastic joint material having a deepest portion 1.5 mm deeper than the deepest portion of the concave portions b25 and extending in the abutting direction of the wood fiber-reinforced cement boards B5, and a 10 mm-wide inclined portion b65 for filling elastic joint material extending in the abutting direction of the wood fiber-reinforced cement boards B5 and forming an inclination toward the inner side of the wood-fiber reinforced cement board B5 from the concave portion b45 for filling elastic joint material. Therefore, in a state where the respective side end portions of the wood fiber-reinforced cement boards B5, B5 are abutted against each other, a 40 mm-wide space having a deepest portion 1.5 mm deeper than the deepest portion of the concave portions b25 and extending along the abutting portion is formed in the surface of the abutting portion by the concave portion b35 for filling elastic joint material, the concave portion b45 for filling elastic joint material, the inclined portion b55 for filling elastic joint material and the inclined portion b65 for filling elastic joint material. This space is a pocket for filling elastic joint material, and the polythiourethane joint material C5 is filled into this pocket for filling elastic joint material. The polythiourethane joint material C5 is disposed so as to fill in this pocket for filling elastic joint material, and also cover a portion of the surfaces of the wood fiber-reinforced cement boards B5, B5.

A polyester sheet D5 is disposed inside the polythiourethane joint material C5, thereby reinforcing the polythiourethane joint material C5. Since the width of the polyester sheet D5 is greater than the width of the pocket for filling elastic joint material, then the polyester sheet D5 is disposed both inside the polythiourethane joint material C5 and covering the pocket for filling elastic joint material and a portion of the surfaces of the wood fiber-reinforced cement boards B5, B5. Furthermore, the polyester sheet D5 has nine openings d5 penetrating the surface per cm$^2$, and the polythiourethane joint material C5 is filled into the openings d5.

Furthermore, in the surface of the polythiourethane joint material C5 filled into the pocket for filling elastic joint material, convex portions c15 and concave portions c25 are provided so as to be continuous with the uneven pattern of the abutted wood fiber-reinforced cement boards B5, B5.

The surfaces of the wood fiber-reinforced cement boards B5, B5 and the polythiourethane joint material C5 are covered with an acrylic elastic coating material E5. Therefore, in the surface of this acrylic elastic coating material E5 there are formed convex portions e15 originating from the convex portions b15 of the wood fiber-reinforced cement board B5, concave portions e25 originating from the concave portions b25 of the wood fiber-reinforced cement board B5, convex portions originating from the convex portions c15 of the polythiourethane joint material C5 and concave portions originating from the concave portions c25 of the polythiourethane joint material C5. In other words, an uneven pattern originating from the uneven pattern in the wood fiber-reinforced cement board B5 and the uneven pattern in the polythiourethane joint material C5 is formed in the surface of the acrylic elastic coating material E5. The acrylic elastic coating material E5 is applied at a rate of 5 kg/m$^2$ or greater. The height of the surface of the acrylic elastic coating material E5 which coats the surface of the wood fiber-reinforced cement board B5 is matched to the height of the surface of the acrylic elastic coating material E5 which coats the surface of the polythiourethane joint material C5.

Therefore, according to the wall structure shown in FIG. 5, although the surface is covered with the acrylic elastic coating material E5 and is jointless, it is possible for the surface to have an uneven pattern. Since the uneven pattern in the surface is created by the uneven pattern in the wood fiber-reinforced cement boards B5 and the uneven pattern in the polythiourethane joint material C5, and a pattern is not applied by means of the method for applying the acrylic elastic coating material E5, then great effort is not required in the coating process and there is little variation in the finished design.

Furthermore, since the depth of the deepest portion of the concave portions b25 of the wood fiber-reinforced cement board B5 is 3.0 mm from the highest portion of the convex portions b15, and the pattern loss ratio is 11%, then the uneven pattern of the wood fiber-reinforced cement board B5 is better reflected in the uneven pattern of the wall, creating a good external appearance, in addition to which weatherproofing and waterproofing are excellent, and there are no problems in respect of the strength of the wall.

Moreover, since a 40 mm-wide pocket for filling elastic joint material which is 1.5 mm deeper than the deepest portion of the concave portions b25 and extends following the abutting portion is formed in the surface of the abutting portion of the side end portions of the wood fiber-reinforced cement boards B5, B5, since the polythiourethane joint material C5 is filled into the pocket for filling elastic joint material, and since the surface of the polythiourethane joint material C5 is coated with acrylic elastic coating material E5 at a rate of 5 kg/m$^2$ or greater, then a sufficient amount of polythiourethane joint material C5 is disposed in the abutting portion of the side end portions of the wood fiber-reinforced cement boards B5, B5, a sufficient amount of acrylic elastic coating material E5 is also disposed thereon, expansion and contraction over time of the abutting portion of the side end portions of the wood fiber-reinforced cement boards B5, B5 is suppressed, and cracks are not liable to occur in the acrylic elastic coating material E5.

Moreover, since the polyester sheet D5 having nine openings d5 perforating the surface per cm$^2$ is disposed inside the polythiourethane joint material C5 in a state where the polythiourethane joint material C5 is filled into the openings d5, then the polythiourethane joint material C5 and the polyester sheet D5 are united into a single body, thereby reinforcing the polythiourethane joint material C5, further suppressing expansion or contraction over time of the abutting portion of the side end portions of the wood fiber-reinforced cement boards B5, B5, and making cracks even less liable to occur in the acrylic elastic coating material E5.

Figure 6:
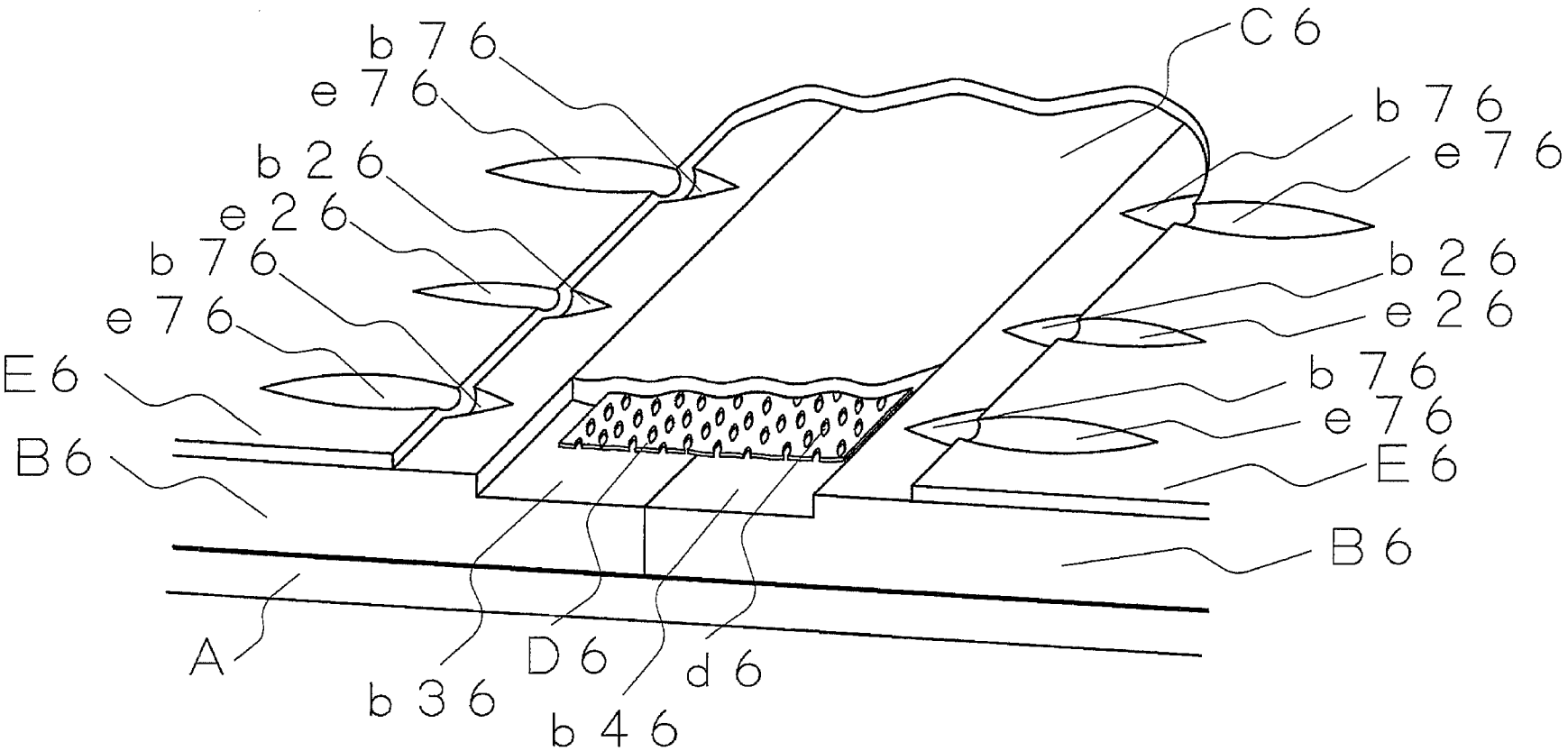
FIG. 6 is an explanatory perspective diagram showing the structure of the vicinity of an abutting portion of wall materials according to yet a further embodiment of a wall structure according to the present invention.

FIG. 6 is an explanatory perspective diagram showing the structure of the vicinity of the abutting portion of wall materials according to yet a further embodiment of the wall structure according to the present invention.

In the wall structure shown in FIG. 6, a wood fiber-reinforced cement board B6 having a thickness of 14 mm, a width of 910 mm and a length of 3030 mm and comprising no shiplap portions in the side end portions is used as a wall material, a polythiourethane joint material C6 is used as an elastic joint material, a 0.4 mm-thick and 50 mm-wide polyester sheet D6 having five openings d6 perforating the surface thereof per cm$^2$ is used as a mesh-shaped material, and an acrylic elastic coating material E6 is used as an elastic coating material.

Two wood fiber-reinforced cement boards B6, B6 are fixed to an underlying material A by nails (not illustrated), with their respective side end portions mutually abutted. As shown in FIG. 6, the wood fiber-reinforced cement boards B6 have, in the surface thereof, an uneven pattern consisting of concave portions b26, concave portions b76 and flat surface portions, and having a pattern loss ratio of 4%. The concave portions b76 are deeper than the concave portions b26, and the depth of the deepest portion of the concave portions b76 is 3.0 mm from the flat surface portions of the wood fiber-reinforced cement board B6. More specifically, since the uneven pattern in the wood fiber-reinforced cement board B6 consists of concave portions b26, concave portions b76 and flat surface portions, then the highest portion of the wood fiber-reinforced cement board B6 is the flat surface portion. The maximum widths of the concave portions b26 and the concave portions b76 are both greater than 5 mm. Moreover, the wood fiber-reinforced cement boards B6 have, in the surface of the right-side end portion thereof, a 30 mm-wide concave portion b36 for filling elastic joint material having a deepest portion 1.5 mm deeper than the deepest portion of the concave portions b76 and extending in the abutting direction of the wood fiber-reinforced cement boards B6, and have, in the surface of the left-side end portion thereof, a 30 mm-wide concave portion b46 for filling elastic joint material having a deepest portion 1.5 mm deeper than the deepest portion of the concave portions b76 and extending in the abutting direction of the wood fiber-reinforced cement boards B6. Therefore, in a state where the respective side end portions of the wood fiber-reinforced cement boards B6, B6 are abutted against each other, a 60 mm-wide space 1.5 mm having a deepest portion deeper than the deepest portion of the concave portions b76 and extending along the abutting portion is formed in the surface of the abutting portion by the concave portion b36 for filling elastic joint material and the concave portion b46 for filling elastic joint material. This space is a pocket for filling elastic joint material, and the polythiourethane joint material C6 is filled into this pocket for filling elastic joint material. The polythiourethane joint material C6 is applied so as to fill in this pocket for filling elastic joint material only.

A polyester sheet D6 having a smaller width than the pocket for filling elastic joint material is disposed inside the polythiourethane joint material C6 which is filled into the pocket for filling elastic joint material, thereby reinforcing the polythiourethane joint material C6. The polyester sheet D6 has five openings d6 penetrating the surface per $cm^2$, and the polythiourethane joint material C6 is filled into the openings d6.

Furthermore, the surface of the polythiourethane joint material C6 which is filled into the pocket for filling elastic joint material is a flat surface, and the height of the surface is matched to the height of the surfaces of the abutted wood fiber-reinforced cement boards B6, B6.

The surfaces of the wood fiber-reinforced cement boards B6, B6 and the polythiourethane joint material C6 are covered entirely with an acrylic elastic coating material E6, and in the surface of this acrylic elastic coating material E6 there are formed concave portions e26 originating from the concave portions b26 of the wood fiber-reinforced cement board B6, and concave portions e76 originating from the concave portions b76 of the wood fiber-reinforced cement board B6. In other words, an uneven pattern originating from the uneven pattern in the wood fiber-reinforced cement board B6 is formed in the surface of the acrylic elastic coating material E6. The acrylic elastic coating material E6 is applied at a rate of 2 $kg/m^2$ or greater. The height of the surface of the acrylic elastic coating material E6 which coats the surface of the wood fiber-reinforced cement board B6 is matched to the height of the surface of the acrylic elastic coating material E6 which coats the surface of the polythiourethane joint material C6. In other words, the height of the surface of the acrylic elastic coating material E6 originating from the flat surface portions of the wood fiber-reinforced cement board B6 is matched to the height of the surface of the acrylic elastic coating material E6 originating from the flat surface portions of the polythiourethane joint material C6.

Therefore, according to the wall structure shown in FIG. 6, although the surface is covered with the acrylic elastic coating material E6 and is jointless, it is possible for the surface to have an uneven pattern. Since the uneven pattern in the surface is created by the uneven pattern in the wood fiber-reinforced cement boards B6, and a pattern is not applied by means of the method for applying the acrylic elastic coating material E6, then great effort is not required in the coating process and there is little variation in the finished design.

Furthermore, since the depth of the deepest portion of the concave portions b76 of the wood fiber-reinforced cement board B6 is 3.0 mm from the flat surface portions, and the pattern loss ratio is 4%, then the uneven pattern of the wood fiber-reinforced cement board B6 is better reflected in the uneven pattern of the wall, creating a good external appearance, in addition to which weatherproofing and waterproofing are excellent, and there are no problems in respect of the strength of the wall.

Moreover, since a 60 mm-wide pocket for filling elastic joint material which is 1.5 mm deeper than the deepest portion of the concave portions b76 and extends following the abutting portion is formed in the surface of the abutting portion of the side end portions of the wood fiber-reinforced cement boards B6, B6, since the polythiourethane joint material C6 is filled into the pocket for filling elastic joint material, and since the surface of the polythiourethane joint material C6 is coated with acrylic elastic coating material E6 at a rate of 2 $kg/m^2$ or greater, then a sufficient amount of polythiourethane joint material C6 is disposed in the abutting portion of the side end portions of the wood fiber-reinforced cement boards B6, B6, a sufficient amount of acrylic elastic coating material E6 is also disposed thereon, expansion and contraction over time of the abutting portion of the side end portions of the wood fiber-reinforced cement boards B6, B6 is suppressed, and cracks are not liable to occur in the acrylic elastic coating material E6.

Moreover, since the polyester sheet D6 having five openings d6 perforating the surface per $cm^2$ is disposed inside the polythiourethane joint material C6 in a state where the polythiourethane joint material C6 is filled into the openings d6, then the polythiourethane joint material C6 and the polyester sheet D6 are united into a single body, thereby reinforcing the polythiourethane joint material C6, further suppressing expansion or contraction over time of the abutting portion of the side end portions of the wood fiber-reinforced cement boards B6, B6, and making cracks even less liable to occur in the acrylic elastic coating material E6.

Furthermore, since the height of the surface of the polythiourethane joint material C6 is matched to the height of the flat surface portions of the abutted wood fiber-reinforced cement boards B6, B6, then when applying the acrylic elastic coating material E6, it is not necessary to pay attention so that the spread portion of the polythiourethane joint material C6 does not create unwanted concave and convex portions in the wall, and hence workability is further improved, variations in the finished design are further reduced, and the external appearance of the wall is even better.

Figure 7:
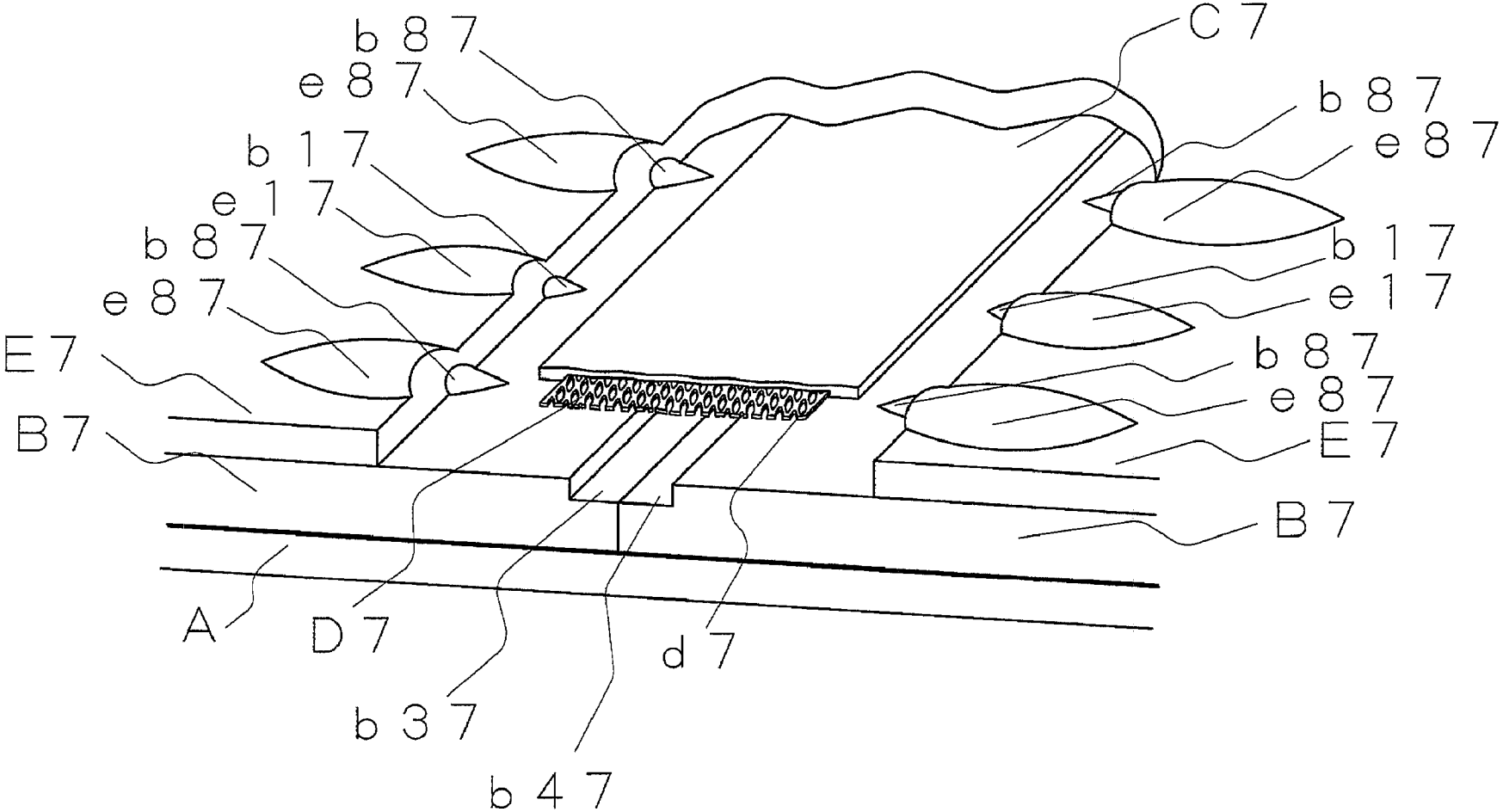
FIG. 7 is an explanatory perspective diagram showing the structure of the vicinity of an abutting portion of wall materials according to yet a further embodiment of a wall structure according to the present invention.

FIG. 7 is an explanatory perspective diagram showing the structure of the vicinity of the abutting portion of wall materials according to yet a further embodiment of the wall structure according to the present invention.

In the wall structure shown in FIG. 7, a wood fiber-reinforced cement board B7 having a thickness of 14 mm, a width of 910 mm and a length of 3030 mm and comprising no shiplap portions in the side end portions is used as a wall material, a polythiourethane joint material C7 is used as an elastic joint material, a 0.4 mm-thick and 50 mm-wide polyester sheet D7 having nine openings d7 perforating the surface thereof per $cm^2$ is used as a mesh-shaped material, and an acrylic elastic coating material E7 is used as an elastic coating material.

Two wood fiber-reinforced cement boards B7, B7 are fixed to an underlying material A by nails (not illustrated), with their respective side end portions mutually abutted. As shown in FIG. 7, the wood fiber-reinforced cement boards B7 have an uneven pattern consisting of convex portions b17, convex portions b87 and flat surface portions; the convex portions b87 are higher than the convex portions b17, and the highest portion of the convex portions b87 is situated at a height of 3.0 mm from the flat surface portions. More specifically, since the uneven pattern in the wood fiber-reinforced cement board B7 consists of convex portions b17, convex portions b87 and flat surface portions, then the deepest portion of the uneven pattern of the wood fiber-reinforced cement board B7 is the flat surface portion. The pattern loss ratio of the wood fiber-reinforced cement board B7 is 9% and the maximum widths of the convex portions b17 and the convex portions b87 are both greater than 5 mm. Moreover, the wood fiber-reinforced cement boards B7 have, in the surface of the right-side end portion thereof, a 10 mm-wide concave portion b37 for filling elastic joint material having a deepest portion 1.5 mm deeper than the flat surface portions and extending in the abutting direction of the wood fiber-reinforced cement boards B7, and have, in the surface of the left-side end portion thereof, a 10 mm-wide concave portion b47 for filling elastic joint material having a deepest portion 1.5 mm deeper than the flat surface portions and extending in the abutting direction of the wood fiber-reinforced cement boards B7. Therefore, in a state where the respective side end portions of the wood fiber-reinforced cement boards B7, B7 are abutted against each other, a 20 mm-wide space having a deepest portion 1.5 mm deeper than the flat surface portions and extending along the abutting portion is formed in the surface of the abutting portion by the concave portion b37 for filling elastic joint material and the concave portion b47 for filling elastic joint material. This space is a pocket for filling elastic joint material, and the polythiourethane joint material C7 is filled into this pocket for filling elastic joint material. The polythiourethane joint material C7 is disposed so as to fill in this pocket for filling elastic joint material, and also covers a portion of the surfaces of the wood fiber-reinforced cement boards B7, B7.

A polyester sheet D7 is disposed inside the polythiourethane joint material C7 which is filled into the pocket for filling elastic joint material, thereby reinforcing the polythiourethane joint material C7. Since the width of the polyester sheet D7 is greater than the width of the pocket for filling elastic joint material, then the polyester sheet is disposed both inside the polythiourethane joint material C7 and covering the pocket for filling elastic joint material and a portion of the surfaces of the wood fiber-reinforced cement boards B7, B7. Furthermore, the polyester sheet D7 has nine openings d7 penetrating the surface per $cm^2$, and the polythiourethane joint material C7 is filled into the openings d7.

Furthermore, the surface of the polythiourethane joint material C7 which is filled into the pocket for filling elastic joint material is a flat surface.

The surfaces of the wood fiber-reinforced cement boards B7, B7 and the polythiourethane joint material C7 are covered entirely with an acrylic elastic coating material E7, and in the surface of this acrylic elastic coating material E7 there are formed convex portions e17 originating from the concave portions b17 of the wood fiber-reinforced cement board B7, and concave portions e87 originating from the concave portions b87 of the wood fiber-reinforced cement board B7. In other words, an uneven pattern originating from the uneven pattern in the wood fiber-reinforced cement board B7 is formed in the surface of the acrylic elastic coating material E7. The acrylic elastic coating material E7 is applied at a rate of 5 $kg/m^2$ or greater. The height of the surface of the acrylic elastic coating material E7 which coats the surface of the wood fiber-reinforced cement board B7 is matched to the height of the surface of the acrylic elastic coating material E7 which coats the surface of the polythiourethane joint material C7. In other words, the height of the surface of the acrylic elastic coating material E7 originating from the flat surface portions of the wood fiber-reinforced cement board B7 is matched to the height of the surface of the acrylic elastic coating material E7 originating from the flat surface portions of the polythiourethane joint material C7.

Therefore, according to the wall structure shown in FIG. 7, although the surface is covered with the acrylic elastic coating material E7 and is jointless, it is possible for the surface to have an uneven pattern. Since the uneven pattern in the surface is created by the uneven pattern in the wood fiber-reinforced cement boards B7, and a pattern is not applied by means of the method for applying the acrylic elastic coating material E7, then great effort is not required in the coating process and there is little variation in the finished design.

Furthermore, since the height of the highest portion of the concave portions b87 of the wood fiber-reinforced cement board B7 is 3.0 mm from the flat surface portions, and the pattern loss ratio is 9%, then the uneven pattern of the wood fiber-reinforced cement board B7 is better reflected in the uneven pattern of the wall, creating a good external appearance, in addition to which weatherproofing and waterproofing are excellent, and there are no problems in respect of the strength of the wall.

Moreover, since a 20 mm-wide pocket for filling elastic joint material having a deepest portion 1.5 mm deeper that the flat surface portions and extending following the abutting portion is formed in the surface of the abutting portion of the side end portions of the wood fiber-reinforced cement boards B7, B7, since the polythiourethane joint material C7 is filled into the pocket for filling elastic joint material, and since the surface of the polythiourethane joint material C7 is coated with acrylic elastic coating material E7 at a rate of 5 $kg/m^2$ or greater, then a sufficient amount of polythiourethane joint material C7 is disposed in the abutting portion of the side end portions of the wood fiber-reinforced cement boards B7, B7, a sufficient amount of acrylic elastic coating material E7 is also disposed thereon, expansion and contraction over time of the abutting portion of the side end portions of the wood fiber-reinforced cement boards B7, B7 is suppressed, and cracks are not liable to occur in the acrylic elastic coating material E7.

Moreover, since the polyester sheet D7 having nine openings d7 perforating the surface per $cm^2$ is disposed inside the polythiourethane joint material C7 in a state where the polythiourethane joint material C7 is filled into the openings d7, then the polythiourethane joint material C7 and the polyester sheet D7 are united into a single body, thereby reinforcing the polythiourethane joint material C7, further suppressing expansion or contraction over time of the abutting portion of the side end portions of the wood fiber-reinforced cement boards B7, B7, and making cracks even less liable to occur in the acrylic elastic coating material E7.

Figure 8:
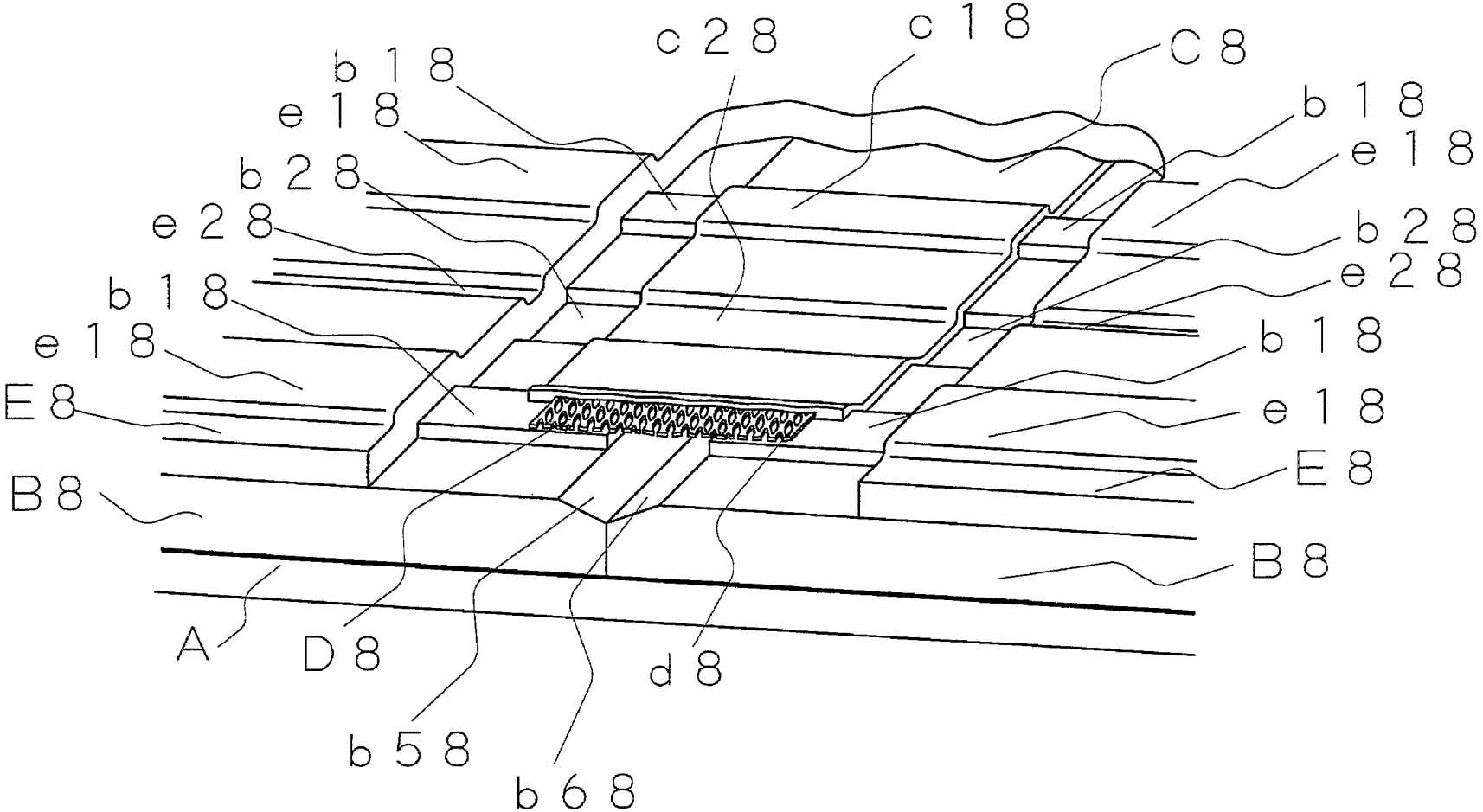
FIG. 8 is an explanatory perspective diagram showing the structure of the vicinity of an abutting portion of wall materials according to yet a further embodiment of a wall structure according to the present invention.

FIG. 8 is an explanatory perspective diagram showing the structure of the vicinity of the abutting portion of wall materials according to yet a further embodiment of the wall structure according to the present invention.

In the wall structure shown in FIG. 8, a wood fiber-reinforced cement board B8 having a thickness of 14 mm, a width of 910 mm and a length of 3030 mm and comprising no shiplap portions in the side end portions thereof is used as a wall material, a polythiourethane joint material C8 is used as an elastic joint material, a 0.4 mm-thick and 50 mm-wide polyester sheet D8 having nine openings d8 perforating the surface thereof per $cm^2$ is used as a mesh-shaped material, and an acrylic elastic coating material E8 is used as an elastic coating material.

Two wood fiber-reinforced cement boards B8, B8 are fixed to an underlying material A by nails (not illustrated), with their respective side end portions mutually abutted. As shown in FIG. 8, the wood fiber-reinforced cement boards B8 have an uneven pattern consisting of convex portions b18 and concave portions b28 in the surface thereof; the depth of the deepest portion of the concave portions b28 is 3.0 mm from the highest portion of the convex portions b18 and the pattern loss ratio is 11%. The maximum widths of the convex portions b18 and the concave portions b28 are both greater than 5 mm. Moreover, the wood fiber-reinforced cement boards B8 have, in the surface of the right-side end portion thereof, a 10 mm-wide inclined portion b58 for filling elastic joint material, the deepest portion of which is 1.5 mm deeper than the deepest portion of the concave portions b28, extending in the abutting direction of the wood fiber-reinforced cement boards B8 and inclined from the inner side of the wood fiber-reinforced cement board B8, and have, in the surface of the left-side end portion thereof, a 10 mm-wide inclined portion b68 for filling elastic joint material, the deepest portion of which is 1.5 mm deeper than the deepest portion of the concave portions b28, extending in the abutting direction of the wood fiber-reinforced cement boards B8 and inclined from the inner side of the wood-fiber reinforced cement board B8. Therefore, in a state where the respective side end portions of the wood fiber-reinforced cement boards B8, B8 are abutted against each other, a 20 mm-wide space having a deepest portion 1.5 mm deeper than the deepest portion of the concave portions b28 and extending along the abutting portion is formed in the surface of the abutting portion by the inclined portion b58 for filling elastic joint material and the inclined portion b68 for filling elastic joint material. This space is a pocket for filling elastic joint material, and the polythiourethane joint material C8 is filled into this pocket for filling elastic joint material. Therefore, the polythiourethane joint material C8 is disposed so as to fill in this pocket for filling elastic joint material, and also cover a portion of the surfaces of the wood fiber-reinforced cement boards B8.

A polyester sheet D8 having a smaller width than the pocket for filling elastic joint material is disposed inside the polythiourethane joint material C8, thereby reinforcing the polythiourethane joint material C8. Since the width of the polyester sheet D8 is greater than the width of the pocket for filling elastic joint material, then the polyester sheet D8 is disposed both inside of the polythiourethane joint material C8 and covering the pocket for filling elastic joint material and a portion of the surfaces of the wood fiber-reinforced cement boards B8, B8. Furthermore, the polyester sheet D8 has nine openings d8 penetrating the surface per $cm^2$, and the polythiourethane joint material C8 is filled into the openings d8.

Furthermore, in the surface of the polythiourethane joint material C8 filled into the pocket for filling elastic joint material, convex portions c18 and concave portions c28 are provided so as to be continuous with the uneven pattern of the abutted wood fiber-reinforced cement boards B8, B8.

The surfaces of the wood fiber-reinforced cement boards B8, B8 and the polythiourethane joint material C8 are covered with an acrylic elastic coating material E8, and in the surface of this acrylic elastic coating material E8 there are formed convex portions e18 originating from the convex portions b18 of the wood fiber-reinforced cement board B8, concave portions e28 originating from the concave portions b28 of the wood fiber-reinforced cement board B8, convex portions originating from the convex portions c18 of the polythiourethane joint material C8 and concave portions originating from the concave portions c28 of the polythiourethane joint material C8. In other words, an uneven pattern originating from the uneven pattern in the wood fiber-reinforced cement board B8 and the uneven pattern in the polythiourethane joint material C8 is formed in the surface of the acrylic elastic coating material E8. The acrylic elastic coating material E8 is applied at a rate of 5 $kg/m^2$ or greater. The height of the surface of the acrylic elastic coating material E8 which coats the surface of the wood fiber-reinforced cement board B8 is matched to the height of the surface of the acrylic elastic coating material E8 which coats the surface of the polythiourethane joint material C8. More specifically, the height of the surface of the convex portions e18 of the acrylic elastic coating material E8 originating from the convex portions b18 of the wood fiber-reinforced cement board B8 is matched to the height of the surface of the convex portions of the acrylic elastic coating material E8 originating from the convex portions c18 of the polythiourethane joint material C8, and the height of the surface of the concave portions e28 of the acrylic elastic coating material E8 originating from the concave portions b28 of the wood fiber-reinforced cement board B8 is matched to the height of the surface of the concave portions of the acrylic elastic coating material E8 originating from the concave portions c28 of the polythiourethane joint material C8.

Therefore, according to the wall structure shown in FIG. 8, although the surface is covered with the acrylic elastic coating material E8 and is jointless, it is possible for the surface to have an uneven pattern. Since the uneven pattern in the surface is created by the uneven pattern in the wood fiber-reinforced cement boards B8 and the uneven pattern in the polythiourethane joint material C8, and a pattern is not applied by means of the method for applying the acrylic elastic coating material E8, then great effort is not required in the coating process and there is little variation in the finished design.

Furthermore, since the depth of the deepest portion of the concave portions b28 of the wood fiber-reinforced cement board B8 is 3.0 mm from the highest portion of the convex portions b18, and the pattern loss ratio is 11%, then the uneven pattern of the wood fiber-reinforced cement board B8 is better reflected in the uneven pattern of the wall, creating a good external appearance, in addition to which weatherproofing and waterproofing are excellent, and there are no problems in respect of the strength of the wall.

Moreover, since a 20 mm-wide pocket for filling elastic joint material which has a deepest portion 1.5 mm deeper than the deepest portion of the concave portions b28 and extends following the abutting portion is formed in the surface of the abutting portion of the side end portions of the wood fiber-reinforced cement boards B8, B8, since the polythiourethane joint material C8 is filled into the pocket for filling elastic joint material, and since the surface of the polythiourethane joint material C8 is coated with acrylic elastic coating material E8 at a rate of 5 $kg/m^2$ or greater, then a sufficient amount of polythiourethane joint material C8 is disposed in the abutting portion of the side end portions of the wood fiber-reinforced cement boards B8, B8, a sufficient amount of acrylic elastic coating material E8 is also disposed thereon, expansion and contraction over time of the abutting portion of the side end portions of the wood fiber-reinforced cement boards B8, B8 is suppressed, and cracks are not liable to occur in the acrylic elastic coating material E8.

Moreover, since the polyester sheet D8 having nine openings d8 perforating the surface per $cm^2$ is disposed inside the polythiourethane joint material C8 in a state where the polythiourethane joint material C8 is filled into the openings d8, then the polythiourethane joint material C8 and the polyester sheet D8 are united into a single body, thereby reinforcing the polythiourethane joint material C8, further suppressing expansion or contraction over time of the abutting portion of the side end portions of the wood fiber-reinforced cement boards B8, B8, and making cracks even less liable to occur in the acrylic elastic coating material E8.

Figure 9:
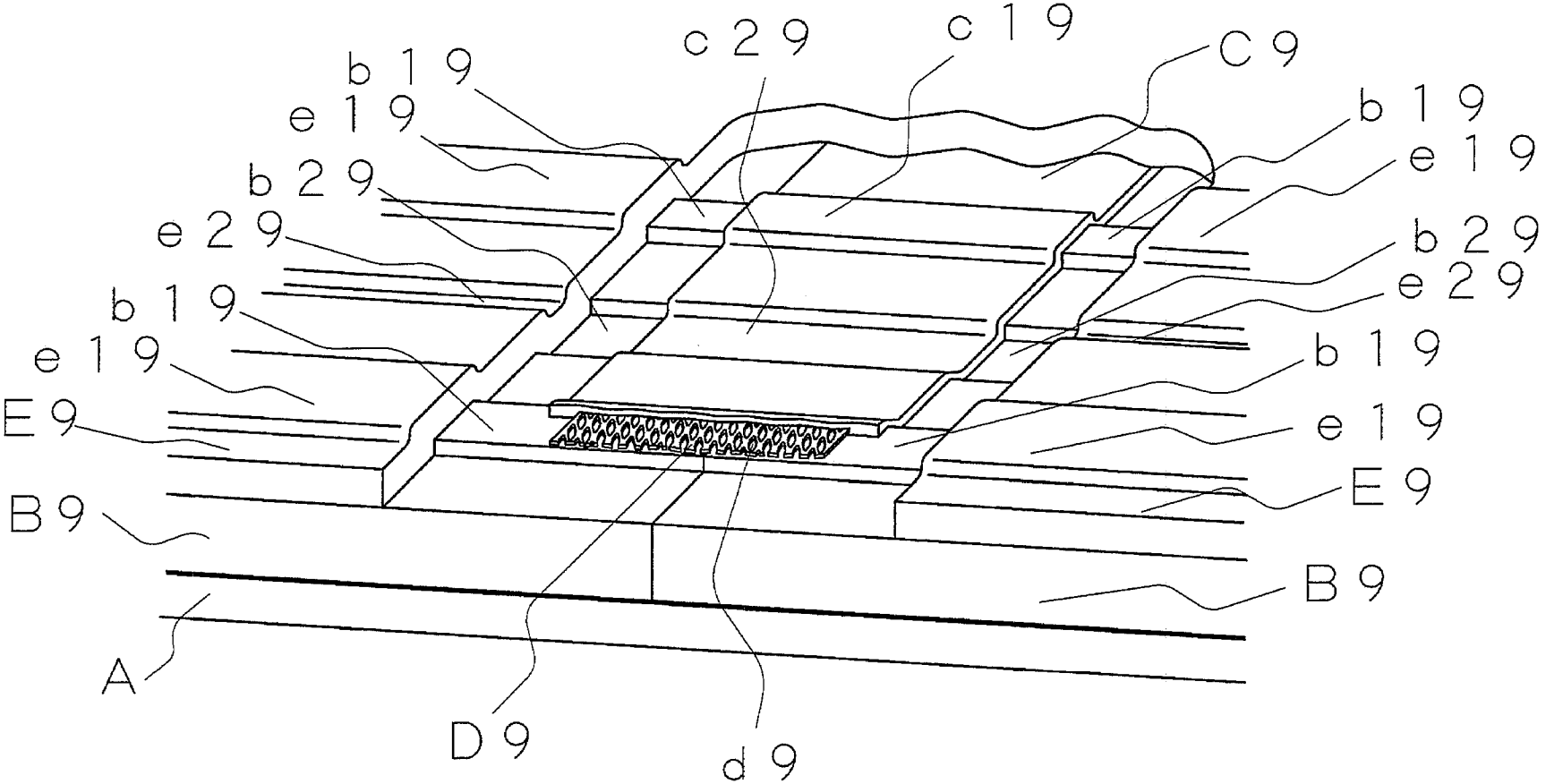
FIG. 9 is an explanatory perspective diagram showing the structure of the vicinity of an abutting portion of wall materials according to yet a further embodiment of a wall structure according to the present invention.

FIG. 9 is an explanatory perspective diagram showing the structure of the vicinity of the abutting portion of wall materials according to yet a further embodiment of the wall structure according to the present invention.

In the wall structure shown in FIG. 9, a wood fiber-reinforced cement board B9 having a thickness of 14 mm, a width of 910 mm and a length of 3030 mm and comprising no shiplap portions in the side end portions is used as a wall material, a polythiourethane joint material C9 is used as an elastic joint material, a 0.4 mm-thick and 50 mm-wide polyester sheet D9 having nine openings d9 perforating the surface thereof per $cm^2$ is used as a mesh-shaped material, and an acrylic elastic coating material E9 is used as an elastic coating material.

Two wood fiber-reinforced cement boards B9, B9 are fixed to an underlying material A by nails (not illustrated), with their respective side end portions mutually abutted. As shown in FIG. 9, the wood fiber-reinforced cement boards B9 have, in the surface thereof, an uneven pattern consisting of convex portions b19 and concave portions b29. The depth of the deepest portion of the concave portions b29 is 3.0 mm from the highest portion of the convex portions b19, and the pattern loss ratio is 11%. The maximum widths of the convex portions b19 and the concave portions b29 are both greater than 5 mm. The polythiourethane joint material C9 is disposed so as to cover the surface of the abutted portion of the side end portions of the wood fiber-reinforced cement boards B9, B9, as well as a portion of the surfaces of the wood fiber-reinforced cement boards B9, B9.

A polyester sheet D9 is disposed inside the polythiourethane joint material C9, thereby reinforcing the polythiourethane joint material C9. The polyester sheet D9 has nine openings d9 penetrating the surface per $cm^2$, and the polythiourethane joint material C9 is filled into the openings d9. Furthermore, in the surface of the polythiourethane joint material C9, convex portions c19 and concave portions c29 are provided so as to be continuous with the uneven pattern of the abutted wood fiber-reinforced cement boards B9, B9.

The surfaces of the wood fiber-reinforced cement boards B9, B9 and the polythiourethane joint material C9 are covered with an acrylic elastic coating material E9. Therefore, in the surface of this acrylic elastic coating material E9, there are formed convex portions e19 originating from the convex portions b19 of the wood fiber-reinforced cement board B9, concave portions e29 originating from the concave portions b29 of the wood fiber-reinforced cement board B9, convex portions originating from the convex portions of the polythiourethane joint material C9 and concave portions originating from the concave portions of the polythiourethane joint material C9. In other words, an uneven pattern originating from the uneven pattern in the wood fiber-reinforced cement board B9 and the uneven pattern in the polythiourethane joint material C9 is formed in the surface of the acrylic elastic coating material E9. The acrylic elastic coating material E9 is applied at a rate of 5 $kg/m^2$ or greater. The height of the surface of the acrylic elastic coating material E9 which coats the surface of the wood fiber-reinforced cement board B9 is matched to the height of the surface of the acrylic elastic coating material E9 which coats the surface of the polythiourethane joint material C9. More specifically, the height of the surface of the convex portions e19 of the acrylic elastic coating material E9 originating from the convex portions b19 of the wood fiber-reinforced cement board B9 is matched to the height of the surface of the convex portions of the acrylic elastic coating material E9 originating from the convex portions c19 of the polythiourethane joint material C9, and the height of the surface of the concave portions e29 of the acrylic elastic coating material E9 originating from the concave portions b29 of the wood fiber-reinforced cement board B9 is matched to the height of the surface of the concave portions of the acrylic elastic coating material E9 originating from the concave portions c29 of the polythiourethane joint material C9.

Therefore, according to the wall structure shown in FIG. 9, although the surface is covered with the acrylic elastic coating material E9 and is jointless, it is possible for the surface to have an uneven pattern. Since the uneven pattern in the surface is created by the uneven pattern in the wood fiber-reinforced cement boards B9 and the uneven pattern in the polythiourethane joint material C9, and a pattern is not applied by means of the method for applying the acrylic elastic coating material E9, then great effort is not required in the coating process and there is little variation in the finished design.

Furthermore, since the depth of the deepest portion of the concave portions b29 of the wood fiber-reinforced cement board B9 is 3.0 mm from the highest portion of the convex portions b19, and the pattern loss ratio is 11%, then the uneven pattern of the wood fiber-reinforced cement board B9 is better reflected in the uneven pattern of the wall, creating a good external appearance, in addition to which weatherproofing and waterproofing are excellent, and there are no problems in respect of the strength of the wall.

Moreover, since the surface of the abutting portion of the side end portions of the wood fiber-reinforced cement boards B9, B9 is covered with a polythiourethane joint material C9 and since the surface of the polythiourethane joint material C9 is coated with acrylic elastic coating material E9 at a rate of 5 $kg/m^2$ or greater, then the polythiourethane joint material C9 is disposed in the abutting portion of the side end portions of the wood fiber-reinforced cement boards B9, B9, a sufficient amount of acrylic elastic coating material E9 is also disposed thereon, expansion and contraction over time of the abutting portion of the side end portions of the wood fiber-reinforced cement boards B9, B9 is suppressed, and cracks are not liable to occur in the acrylic elastic coating material E9.

Moreover, since the polyester sheet D9 having nine openings d9 perforating the surface per $cm^2$ is disposed inside the polythiourethane joint material C9 in a state where the polythiourethane joint material C9 is filled into the openings d9, then the polythiourethane joint material C9 and the polyester sheet D9 are united into a single body, thereby reinforcing the polythiourethane joint material C9, further suppressing expansion or contraction over time of the abutting portion of the side end portions of the wood fiber-reinforced cement boards B9, B9, and making cracks even less liable to occur in the acrylic elastic coating material E9.

Embodiments of the present invention were described above, but the present invention is not limited to these, and various modifications may be adopted within the scope of the claims of the present invention.

As described above, according to the present invention, it is possible to provide a wall structure which, despite having a surface that is covered with elastic coating material and is jointless, has an uneven pattern in the surface, without requiring a great effort in the coating process and with little variation in the finished design.

What is claimed is:

1. A wall structure, the surface of which is covered with an elastic coating material and is jointless, and which has an uneven pattern in the surface, wherein the wall structure comprises a wall material, an elastic joint material, a mesh-shaped material, and an elastic coating material, the wall material has the uneven pattern in the surface, and is fixed in a state where a side end portion of the wall material is abutted with a side end portion of another wall material, the elastic joint material covers the surface of the abutting portion of the side end portions of the wall materials, the mesh-shaped material has a plurality of openings through which the elastic joint material can pass and is disposed inside the elastic joint material, the elastic coating material coats the entire surfaces of the wall materials and the elastic joint materials, the uneven pattern of the surface of the wall structure is formed by coating the uneven pattern of the wall materials with the elastic coating material, a height difference between the deepest portion and the highest portion of the uneven pattern of the wall materials is 2.0 to 4.0 mm, a pattern loss ratio of the uneven pattern of the wall material is 15% or less, and an amount of the elastic coating material coating the surfaces of wall materials and the elastic joint materials is 2 to 6 $kg/m^2$.

2. The wall structure according to claim 1, wherein
a pocket for filling the elastic joint material is formed in the surface of the abutting portion of the side end portions of the wall materials,
the pocket for filing the elastic joint material has a width of 1.0 to 60 mm centered on the abutting portion of the wall materials, extends along the abutting portion, and has a deepest portion 0.5 to 5.0 mm deeper than the deepest portion of the uneven pattern of the wall materials, and
the elastic joint material is filled into the pocket for filling the elastic joint material.

3. The wall structure according to claim 1, wherein 3 to 9 of the openings are provided per $cm^2$ in the surface of the mesh-shaped material, and the elastic joint material is filled into the openings.

4. The wall structure according to claim 2, wherein 3 to 9 of the openings are provided per $cm^2$ in the surface of the mesh-shaped material, and the elastic joint material is filled into the openings.

5. The wall structure according to any of claims 1 to 4, wherein the width of concave portions or convex portions of the uneven pattern of the wall material is equal to or greater than 5 mm.

6. The wall structure according to any of claims 1 to 4, wherein an uneven pattern which is continuous with the uneven pattern of the surface of the wall materials is formed in the surface of the elastic joint material.

7. The wall structure according to any of claims 1 to 4, wherein the width of concave portions or convex portions of the uneven pattern of the wall materials is equal to or greater than 5 mm, an uneven pattern which is continuous with the uneven pattern of the surface of the wall materials is formed in the surface of the elastic joint material.

8. The wall structure according to any of claims 1 to 4, wherein the surface of the elastic joint material is a flat surface.

9. The wall structure according to any of claims 1 to 4, wherein the width of concave portions or convex portions of the uneven pattern of the wall materials is equal to or greater than 5 mm, the surface of the elastic joint material is a flat surface.

10. The wall structure according to claim 2 or 4, wherein the elastic joint material is disposed only so as to fill the pocket for filling the elastic joint material, and the height of the surface of the elastic joint material is matched to the height of the surface of the abutted wall materials.

11. The wall structure according to claim 2 or 4, wherein
the width of concave portions or convex portions of the uneven pattern of the wall materials is equal to or greater than 5 mm,
the elastic joint material is disposed only so as to fill the pocket for filling the elastic joint material,
and the height of the surface of the elastic joint material is matched to the height of the surface of the abutted wall materials.

12. The wall structure according to claim 2 or 4, wherein
an uneven pattern which is continuous with the uneven pattern of the surface of the wall materials is formed in the surface of the elastic joint material,
the elastic joint material is disposed only so as to fill the pocket for filling the elastic joint material,
and the height of the surface of the elastic joint material is matched to the height of the surface of the abutted wall materials.

13. The wall structure according to claim 2 or 4, wherein
the surface of the elastic joint material is a flat surface,
the elastic joint material is disposed only so as to fill the pocket for filling the elastic joint material,
and the height of the surface of the elastic joint material is matched to the height of the surface of the abutted wall materials.

14. The wall structure according to claim 2 or 4, wherein
the width of concave portions or convex portions of the uneven pattern of the wall materials is equal to or greater than 5 mm,
an uneven pattern which is continuous with the uneven pattern of the surface of the wall materials is formed in the surface of the elastic joint material,
the elastic joint material is disposed only so as to fill the pocket for filling the elastic joint material,
and the height of the surface of the elastic joint material is matched to the height of the surface of the abutted wall materials.

15. The wall structure according to claim 2 or 4, wherein
the width of concave portions or convex portions of the uneven pattern of the wall materials is equal to or greater than 5 mm,
the surface of the elastic joint material is a flat surface,
the elastic joint material is disposed only so as to fill the pocket for filling the elastic joint material,
and the height of the surface of the elastic joint material is matched to the height of the surface of the abutted wall materials.

* * * * *